US009793629B2

(12) United States Patent
Tateishi

(10) Patent No.: US 9,793,629 B2
(45) Date of Patent: Oct. 17, 2017

(54) ELECTRIC CONNECTOR

(71) Applicant: DAI-ICHI SEIKO CO., LTD., Kyoto-shi (JP)

(72) Inventor: Jin Tateishi, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 15/337,828

(22) Filed: Oct. 28, 2016

(65) Prior Publication Data

US 2017/0133774 A1 May 11, 2017

(30) Foreign Application Priority Data

Nov. 10, 2015 (JP) ..... 2015-220695

(51) Int. Cl.
*H01R 12/88* (2011.01)
*H01R 12/61* (2011.01)
*H01R 13/627* (2006.01)

(52) U.S. Cl.
CPC ..... *H01R 12/616* (2013.01); *H01R 13/6273* (2013.01)

(58) Field of Classification Search
CPC ..... H01R 12/88; H01R 12/85; H01R 12/82; H01R 12/79; H01R 23/684
(Continued)

(56) References Cited

U.S. PATENT DOCUMENTS 4,936,790 A * 6/1990 De La Cruz ..... H01R 12/87 235/482
2007/0105423 A1* 5/2007 Gillespie ..... H01R 12/774 439/260
(Continued)

FOREIGN PATENT DOCUMENTS

JP 9-134763 5/1997
JP 2002-289283 10/2002
(Continued)

OTHER PUBLICATIONS

Extended European Search Report issued Mar. 23, 2017 in Application No. 16197522.2.
(Continued)

*Primary Examiner* — Gary Paumen
(74) *Attorney, Agent, or Firm* — Oblon, McClelland, Maier & Neustadt, L.L.P.

(57) ABSTRACT

The retainability and electric connection reliability of a plate-shaped signal transmission medium can be increased by a simple configuration while the operability of an actuator is improved. Pre-pressing protruding portions which create a clicking sensation of a turning operation of the actuator are provided in part of a region in a longitudinal direction of the actuator so that the pressing force of the pre-pressing protruding portions with respect to the plate-shaped signal transmission medium is applied to the part in the longitudinal direction of the actuator, and the pressing force of the pre-pressing protruding portions with respect to the plate-shaped signal transmission medium is prevented from being largely increased even when the actuator is enlarged in the multipolar arrangement direction. As a result, the operating force for the actuator is reduced, and, on the other hand, the final fixation state of the plate-shaped signal transmission medium is configured to be good by maintaining the pressing force of the medium pressing portion.

4 Claims, 28 Drawing Sheets

(58) Field of Classification Search
USPC ..... 439/260, 261, 489, 488
See application file for complete search history.

(56) References Cited

U.S. PATENT DOCUMENTS

| | | | | |
|---|---|---|---|---|
| 2010/0120280 | A1* | 5/2010 | Shen | H01R 23/667 439/329 |
| 2016/0204533 | A1* | 7/2016 | Ogino | H01R 12/88 439/660 |

FOREIGN PATENT DOCUMENTS

| | | | |
|---|---|---|---|
| JP | 2006-338955 | A | 12/2006 |
| JP | 2007-042378 | A | 2/2007 |
| JP | 2008-53123 | A | 3/2008 |
| JP | 2011-233487 | A | 11/2011 |
| TW | 201125219 | A1 | 7/2011 |
| WO | WO 2006/026036 | A1 | 3/2006 |

OTHER PUBLICATIONS

Office Action issued Aug. 30, 2017 in Japanese Patent Application 2015-220695 with English Translation.

* cited by examiner

ELECTRIC CONNECTOR

BACKGROUND OF THE INVENTION

Field of the Invention

The present invention relates to an electric connector in which an actuator turnably attached to an insulating housing is provided with medium pressing portions, which press and contact a surface of a plate-shaped signal transmission medium.

Description of Related Art

Generally, in various electric devices, etc. various electric connectors are widely used as means for electrically connecting various plate-shaped signal transmission media such as flexible printed circuits (FPC) and flexible flat cables (FFC). For example, in an electric connector used by being mounted on a printed wiring board like Japanese Patent Application Laid-Open No. H09-134763, Japanese Patent Application Laid-Open No. 2002-289283, etc., the above described plate-shaped signal transmission medium composed of for example, FPC or FFC is inserted therein through an opening of an insulating housing (insulator), and an actuator (connection operating means), which maintains the plate-shaped signal transmission medium in an open state when it is at "standby position (open position)" at that point of time, is configured to be turned so as to be pushed down by operating force of an operator toward "acting position (closed position)" in a front side or a rear side of the electric connector.

Then, when the actuator (connection operating means) is operated to be turned to the "acting position (closed position)" at which the plate-shaped signal transmission medium is sandwiched, medium pressing portions (pressurizing portions) provided on the actuator are brought into pressure-contact with the surface of the plate-shaped signal transmission medium (for example, FPC or FFC), and the plate-shaped signal transmission medium is sandwiched by the pressing force of the medium pressing portions (pressurizing portions) of the actuator and caused to be in a fixed state. On the other hand, when the actuator at the "acting position (closed position)" is operated to be turned to the direction in which the actuator is raised to the upper side toward the original "standby position (open position)", the pressing force of the medium pressing portions (pressurizing portions) of the actuator is cancelled, and, when the actuator reaches the "standby position (open position)", the plate-shaped signal transmission medium can be removed.

The actuator is turned to the "acting position (closed position)" in the above described manner, and the medium pressing portions (pressurizing portions) are brought into pressure-contact with the plate-shaped signal transmission medium (for example, FPC or FFC). As a result, electrically-conductive paths provided on the plate-shaped signal transmission medium are brought into contact with a plurality of contact members, which are arranged in multipolar shapes in the insulating housing, thereby forming signal circuits or ground circuits.

In this case, often employed is a configuration in which, at the timing immediately before the medium pressing portions (pressurizing portions) of the actuator reach the "acting position (closed position)", pre-pressing protruding portions, which are formed so that protruding amounts thereof with respect to the plate-shaped signal transmission medium (for example, FPC or FFC) are somewhat larger than those of the medium pressing portions, are momently brought into pressure-contact with the surface of the plate-shaped signal transmission medium, and a clicking sensation in the turning operation of the actuator is created when a pressing action by the medium pressing portions is carried out thereafter.

However, recent electronic devices have a tendency that the number of electrodes of signal transmission is large, and the numbers of the contact members and the medium pressing portions (pressurizing portions) of the actuator are increasing in proportion to the increase of the number of electrodes. In the electric connector having such a multipolar structure, large operating force has to be applied to the actuator along with the increase of the number of electrodes. If the number of electrodes of signal transmission is equal to or more than a certain number, it is conceivable that the applying force required for the operation of the actuator becomes excessive and that the operation of the actuator becomes difficult.

In order to solve such a problem of the operability of the actuator, a measure of reducing the protruding amounts (pressing margins) of the medium pressing portions and the pre-pressing protruding portions with respect to the plate-shaped signal transmission medium (for example, FPC or FFC) has been conventionally carried out. However, such a configuration has a problem that the retainability and electric connection reliability with respect to the plate-shaped signal transmission medium are reduced, and, furthermore, the clicking sensation of the turning operation is also reduced.

The inventor of this application discloses conventional literature of the present invention as following.

[Patent Literature 1] Japanese Patent Application Laid-Open No. H09-134763

[Patent Literature 2] Japanese Patent Application Laid-Open No. 2002-289283

Therefore, it is an object of the present invention to provide an electric connector capable of increasing the retainability and electric connection reliability with respect to the plate-shaped signal transmission medium by a simple configuration while improving the operability of the actuator.

SUMMARY OF THE INVENTION

In order to achieve the above described object, the present invention employs a configuration of an electric connector having: an insulating housing to which a plate-shaped signal transmission medium is to be inserted; a plurality of contact members arranged in multipolar shapes in the insulating housing; and an actuator attached to the insulating housing turnably about a turning center determined in advance and configured to be subjected to a turning operation from a standby position toward an acting position, the actuator provided with a medium pressing portion configured to be in a disposition relation that the medium pressing portion is pressed against and in contact with a surface of the plate-shaped signal transmission medium in a state in which the actuator is operated to be turned from the standby position to the acting position; wherein the actuator is provided with, in a vicinity part of a downstream side of the medium pressing portion in a direction of the turning operation, a pre-pressing protruding portion(s) that is projecting to a position having a longer distance from the turning center than that of the medium pressing portion and creates a clicking sensation of the turning operation; and the pre-pressing protruding portion is provided in part of a region in a longitudinal direction of the actuator that is a multipolar arrangement direction of the contact members.

According to the present invention having such a configuration, the pressing force of the pre-pressing protruding portions with respect to the plate-shaped signal transmission medium is applied only in part of the longitudinal direction of the actuator. Therefore, even when the actuator is enlarged in the multipolar arrangement direction of the contact members along with increase of the number of electrodes of signal transmission, the pressing force of the pre-pressing protruding portions with respect to the plate-shaped signal transmission medium is not largely increased, the operating force to the actuator in a stage before the plate-shaped signal transmission medium is finally fixed, and, on the other hand, the pressing force of the medium pressing portion is maintained without being reduced. Therefore, the final fixation state of the plate-shaped signal transmission medium is obtained well.

Moreover, the present invention can employ a configuration in which the pre-pressing protruding portions are disposed in both-side regions in the longitudinal direction of the actuator, and the pre-pressing protruding portion is not provided in a central region in the longitudinal direction of the actuator.

Also, the present invention can employ a configuration in which the pre-pressing protruding portions are scattered at an interval determined in advance in the longitudinal direction of the actuator.

Furthermore, in the present invention, it is desired that the contact member be provided with a contact-point portion that is to be brought into pressure-contact with the plate-shaped signal transmission medium; and the pre-pressing protruding portion be provided with a deformation allowing portion formed by space that houses an elastically deformed part of the plate-shaped signal transmission medium in a state in which the contact-point portion of the contact member is in pressure-contact with the plate-shaped signal transmission medium.

According to the present invention having such a configuration, the elastically deformed part of the plate-shaped signal transmission medium generated by being pressed by the medium pressing portion of the actuator is housed in the deformation allowing portion, and, as a result, the plate-shaped signal transmission medium is caused to be in a latched state. Therefore, the retainability of the plate-shaped signal transmission medium is improved.

As described above, the electric connector according to the present invention is configured so that the pre-pressing protruding portions which is protruding to the turning-radius outer side of the actuator than the medium pressing portion, which is provided on the actuator so as to press and contact the surface of the plate-shaped signal transmission medium, and creates clicking sensation of the turning operation is provided in the part of the region in the longitudinal direction of the actuator which is the multipolar arrangement direction of the contact members, thereby applying the pressing force of the pre-pressing protruding portion for the plate-shaped signal transmission medium to the part in the longitudinal direction of the actuator, preventing the pressing force of the pre-pressing protruding portions for the plate-shaped signal transmission medium from being largely increased even when the actuator is enlarged in the multipolar arrangement direction of the contact members, and reducing the operating force to the actuator in the stage before the plate-shaped signal transmission medium is finally fixed. On the other hand, the final fixation state of the plate-shaped signal transmission medium is configured to be good by similarly maintaining the pressing force of the medium pressing portion. Therefore, the retainability and electric connection reliability of the plate-shaped signal transmission medium can be enhanced by the simple configuration while improving the operability of the actuator, and the quality and reliability of the electric connector can be significantly improved at low cost.

DETAILED DESCRIPTION OF THE PREFERRED EMBODIMENT

Figure 1:
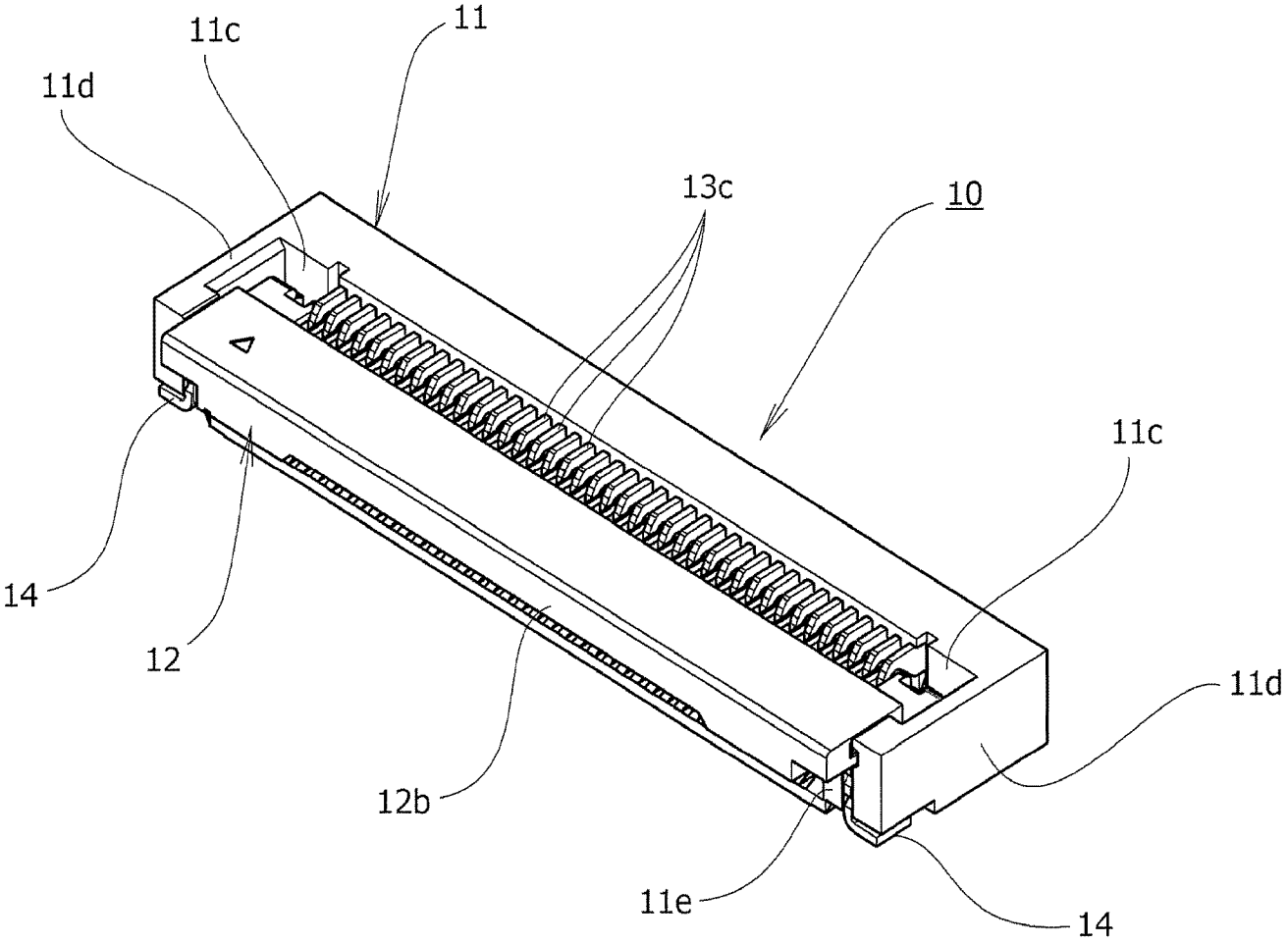
FIG. 1 is an external perspective explanatory view showing an electric connector according to an embodiment of the present invention and showing, from a front side, an entire configuration of a case in which an actuator is pushed down to an acting position (closed position) in a state in which a plate-shaped signal transmission medium is not inserted.
Figure 2:
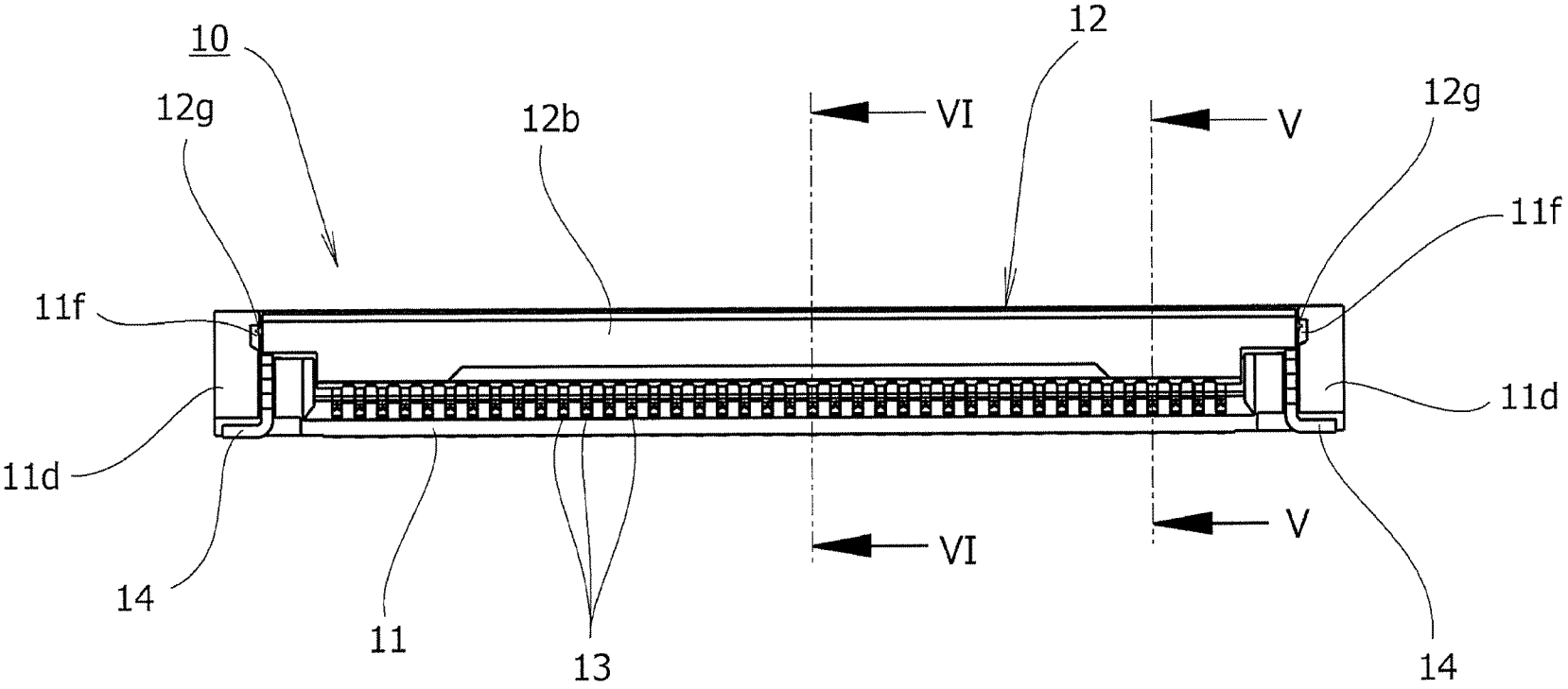
FIG. 2 is a front explanatory view of the electric connector in a closed state shown in FIG. 1.
Figure 3:
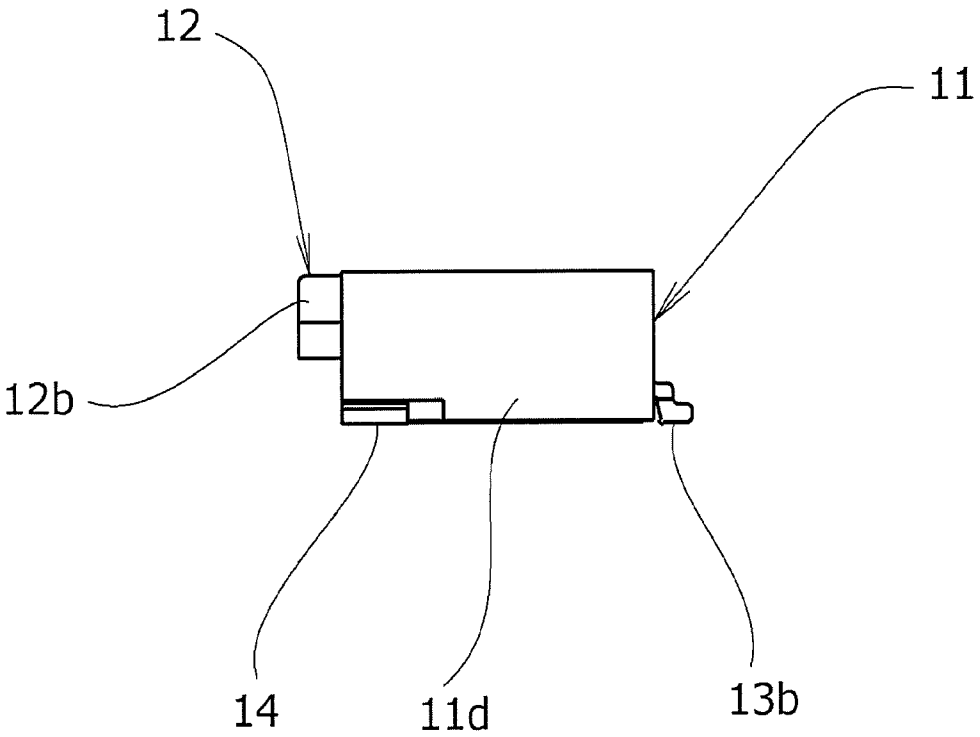
FIG. 3 is a lateral explanatory view of the electric connector in the closed state shown in FIG. 1 and FIG. 2.
Figure 4:
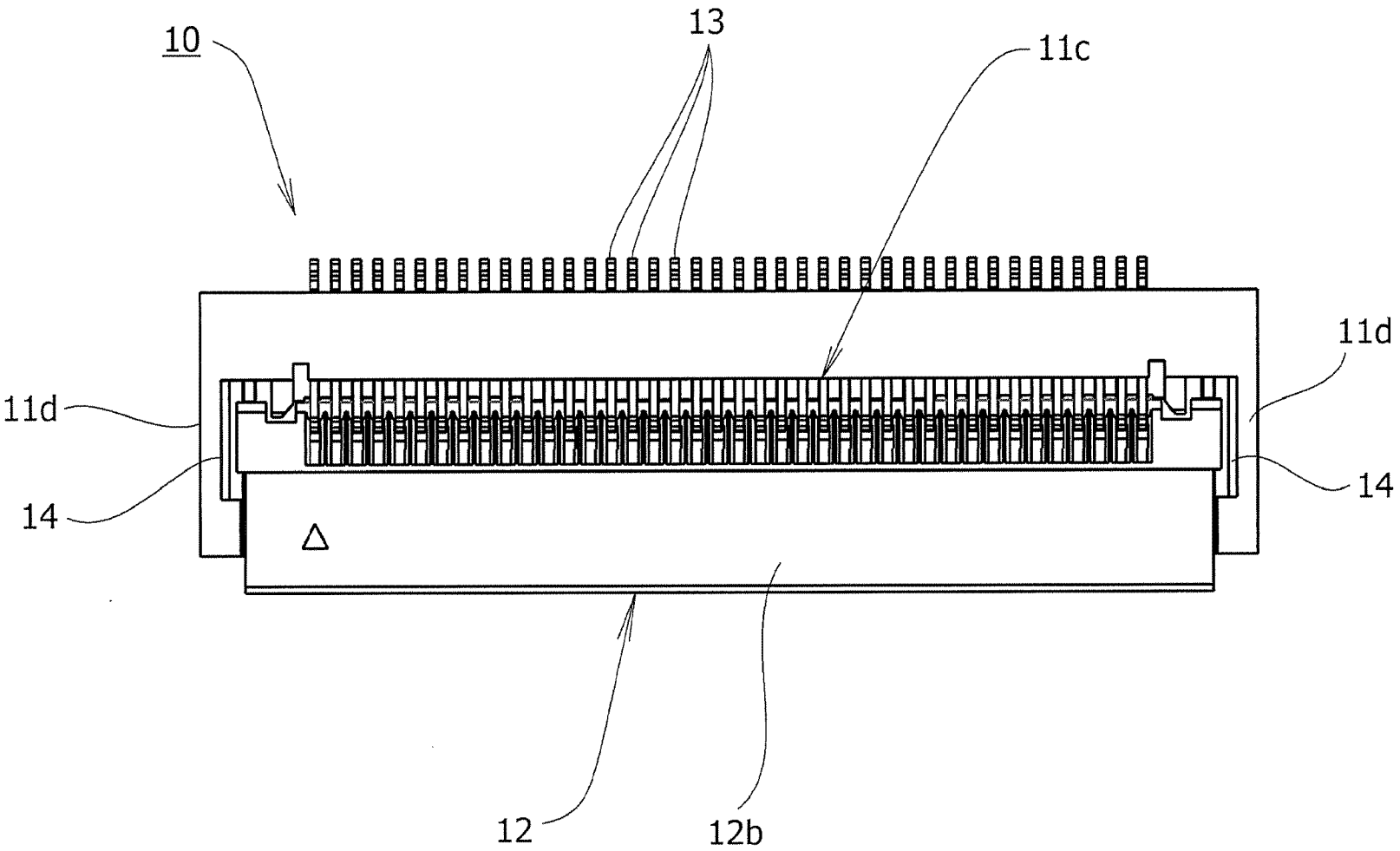
FIG. 4 is a plan explanatory view of the electric connector in the closed state shown in FIG. 1 to FIG. 3.
Figure 5:
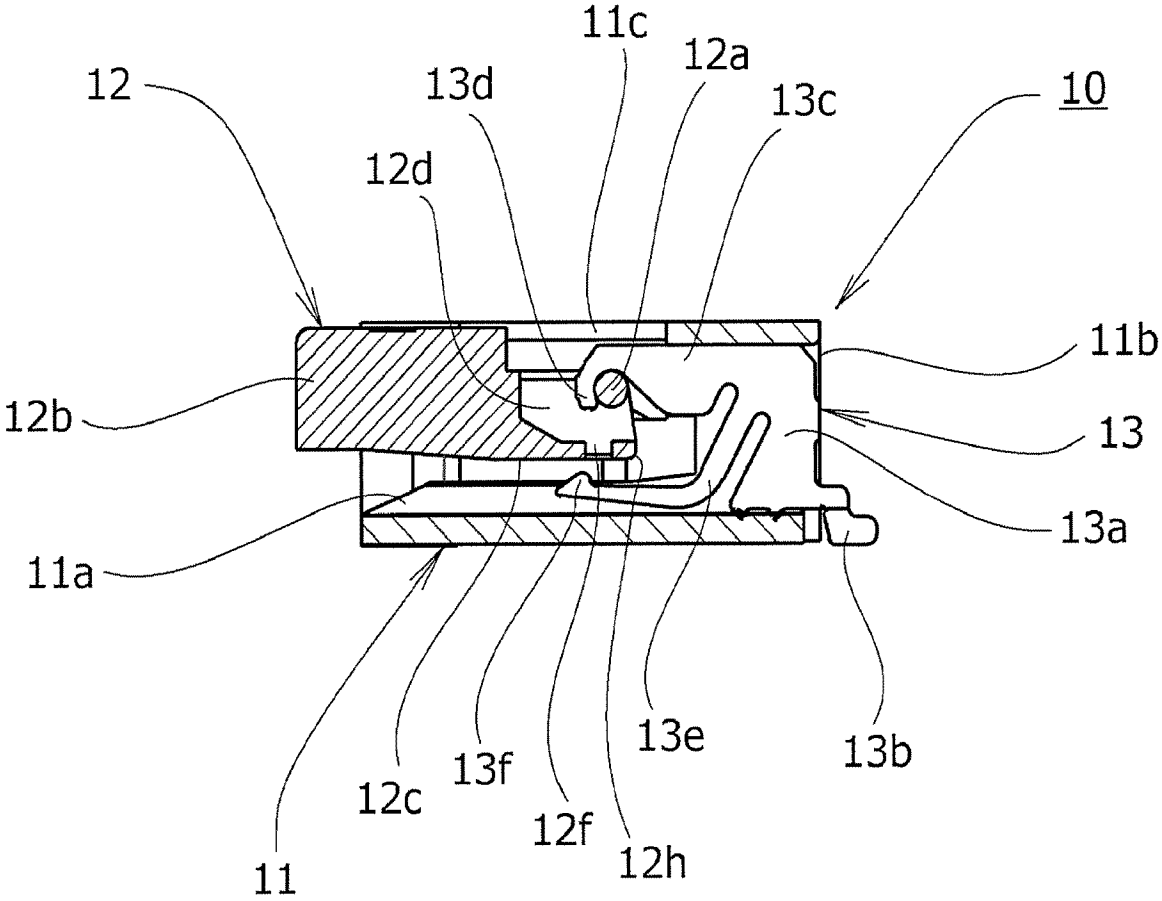
FIG. 5 is an explanatory view showing, in an enlarged manner, a transverse cross section along a line V-V in FIG. 2.
Figure 6:
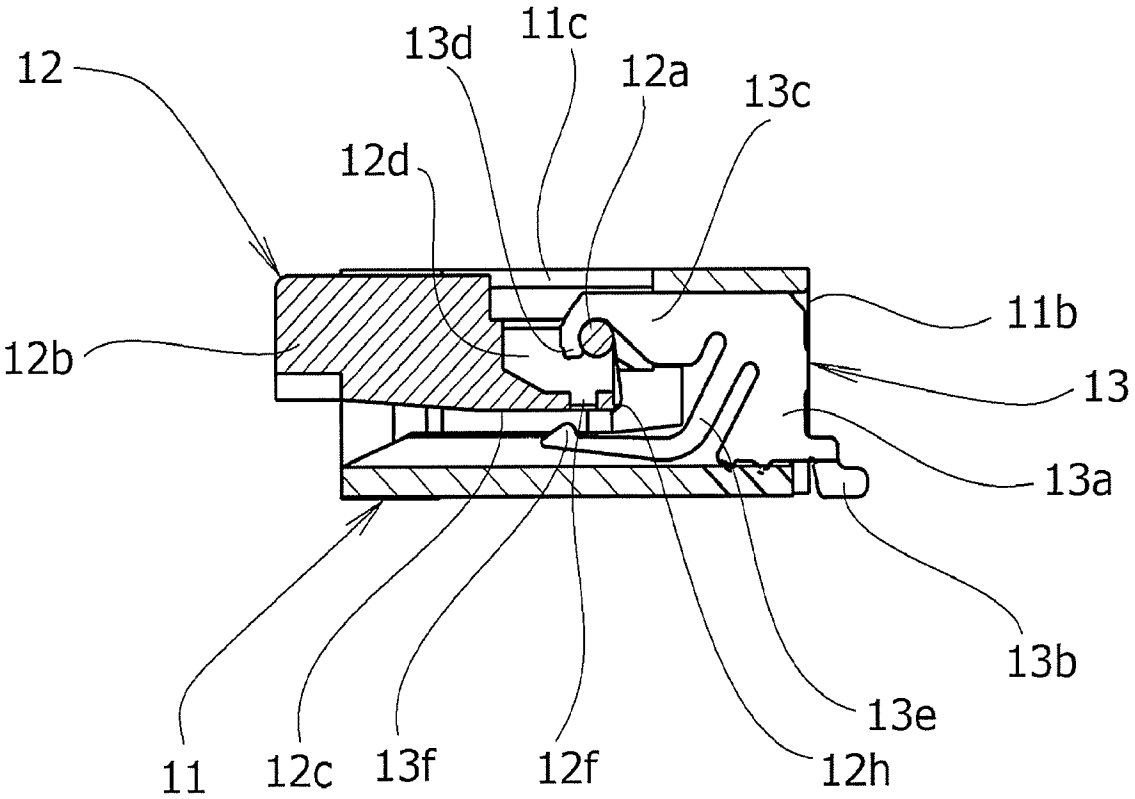
FIG. 6 is an explanatory view showing, in an enlarged manner, a transverse cross section along a line VI-VI in FIG. 2.

Hereinafter, an embodiment in which the present invention is applied to an electric connector, which is used by being mounted on a printed wiring board in order to carry out connection of a plate-shaped signal transmission medium composed of a flexible printed circuit (FPC), flexible flat cable (FFC), or the like, will be described in detail based on drawings.

[About Overall Structure of Electric Connector]

More specifically, an electric connector 10 according to an embodiment of the present invention shown in FIG. 1 to FIG. 6 is an electric connector having a so-called front-flip-type structure in which an actuator 12 serving as a connection operating means is attached to a front edge part (left edge part in FIG. 5 and FIG. 6) of an insulating housing 11, and the above described actuator (connection operating means) 12 is in a state in which the actuator 12 is turned so as to be pushed down toward a connector front end side (left end side in FIG. 5 and FIG. 6) to which a terminal part of a plate-shaped signal transmission medium (for example, FPC or FFC) F is to be inserted.

The insulating housing 11 in this case is formed by a slenderly extending hollow-frame-shaped insulating member. A longitudinal direction of the insulating housing 11 will be hereinafter referred to as "connector longitudinal direction", the terminal part of the plate-shaped signal transmission medium (for example, FPC or FFC) F is assumed to be inserted from "connector front side" toward "connector rear side", and the inserting direction of the plate-shaped signal transmission medium F will be referred to as "medium inserting direction". Furthermore, the terminal part of the plate-shaped signal transmission medium F is assumed to be removed from "connector rear side" toward "connector front side", and the removing direction of the plate-shaped signal transmission medium F will be referred to as "medium removing direction".

Note that the electric connector 10 according to the present embodiment has a left-right symmetric structure in the connector longitudinal direction, and the same constituent members which are in left-right symmetric disposition relations will be described with the same reference signs.

In the hollow shape of the insulating housing 11, a plurality of electrically-conductive contact members 13, 13, and so on are attached as contact members formed by thin-plate-shaped metal members having appropriate shapes. The plurality of electrically-conductive contact members 13, 13, and so on are disposed so as to form multipolar shapes with appropriate intervals therebetween along the connector longitudinal direction, and the electrically-conductive contact members 13 are respectively attached to a plurality of contact attachment grooves 11*a*, 11*a*, and so on formed on a bottom-portion inner wall surface, which forms interior space of the insulating housing 11, with certain intervals therebetween in the connector longitudinal direction.

Each of the electrically-conductive contact members 13 is used for signal transmission or for ground connection in a state in which the electrically-conductive contact member 13 is mounted on an electrically-conductive path formed on an illustration-omitted printed wiring board by solder joining.

Figure 7:
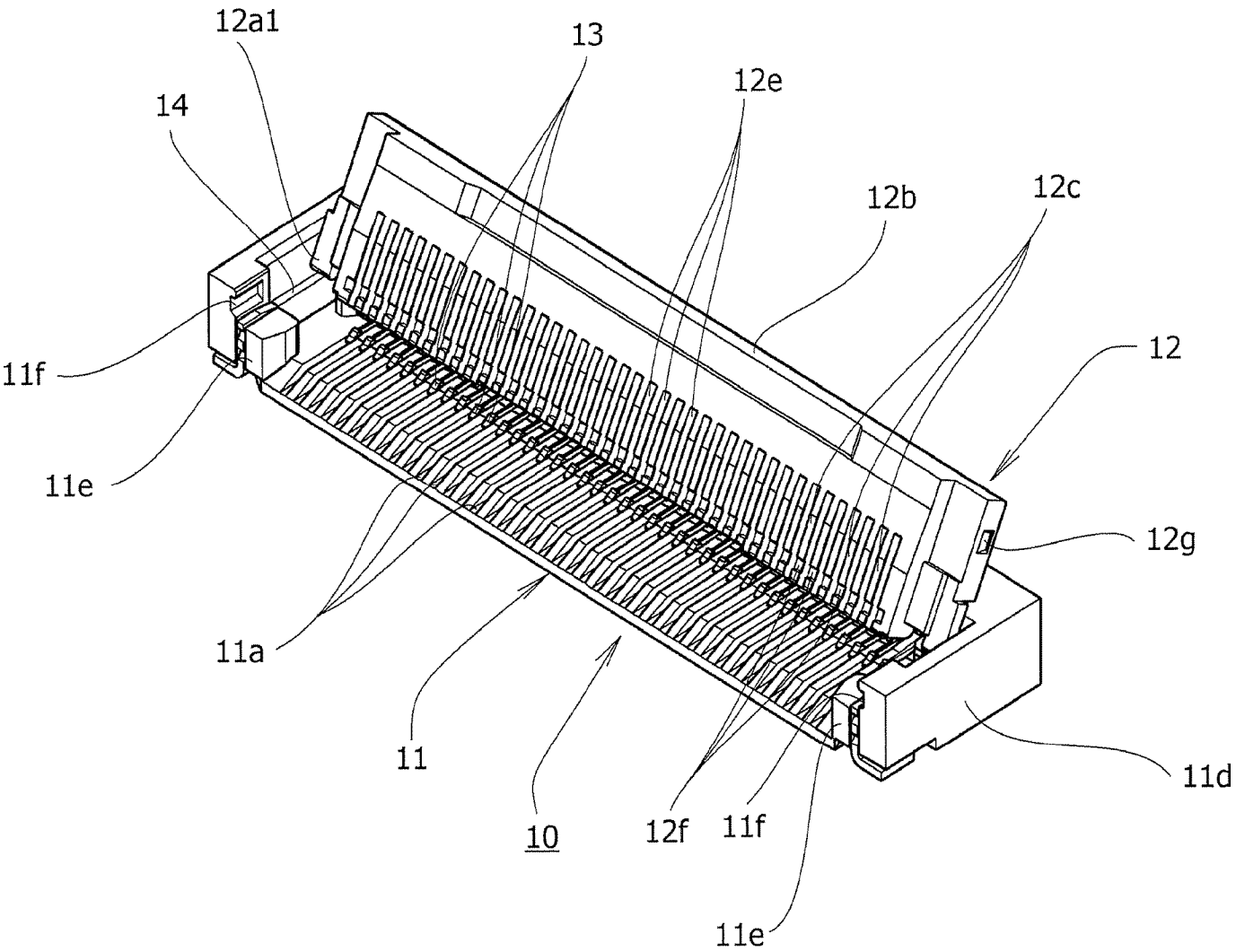
FIG. 7 is an external perspective explanatory view showing, from a front side, an entire configuration in a state in which the actuator of the electric connector shown in FIG. 1 to FIG. 6 is flipped up to a standby position (open position)
Figure 8:
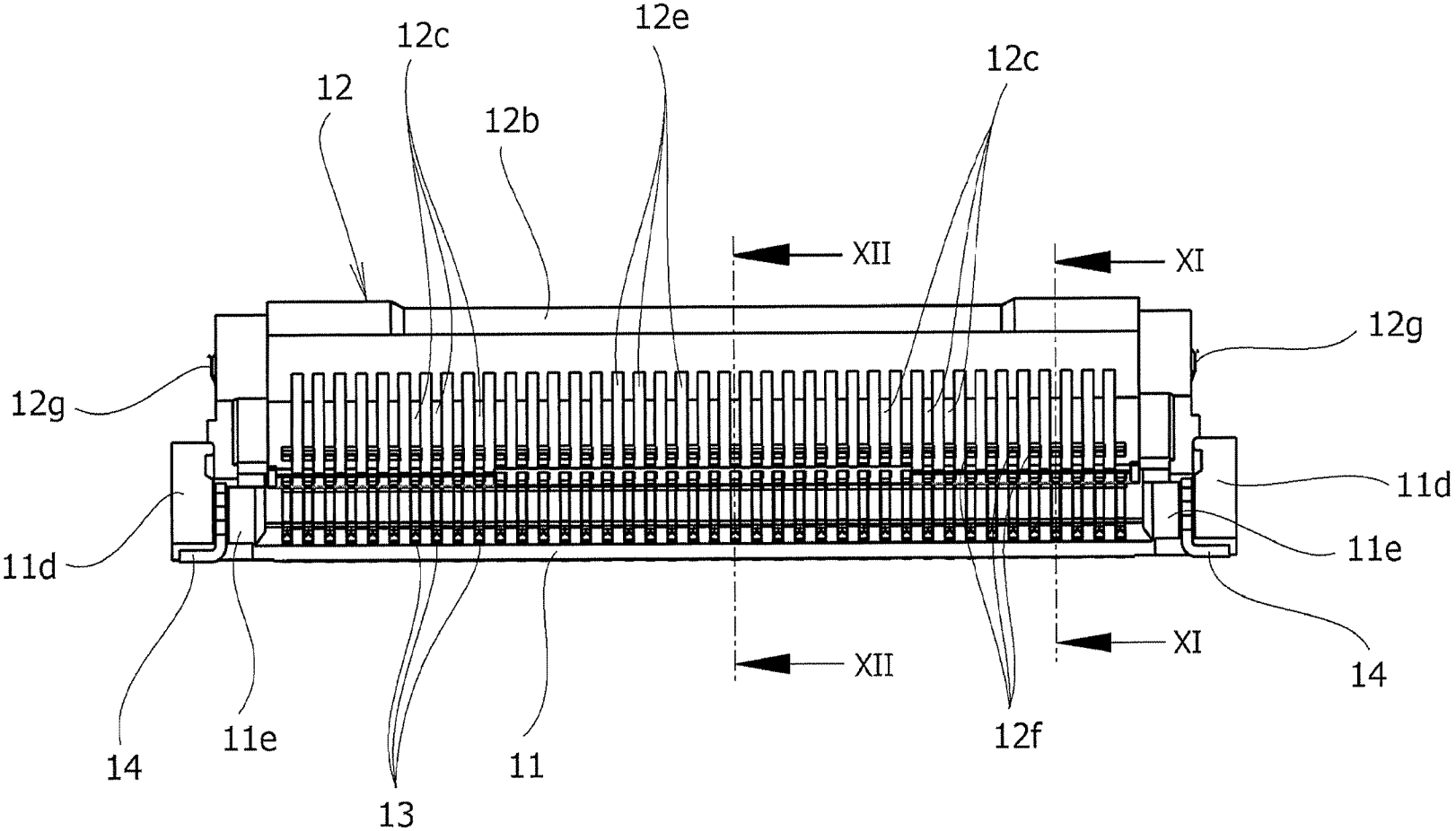
FIG. 8 is a front explanatory view showing the electric connector in the actuator open state shown in FIG. 7.
Figure 9:
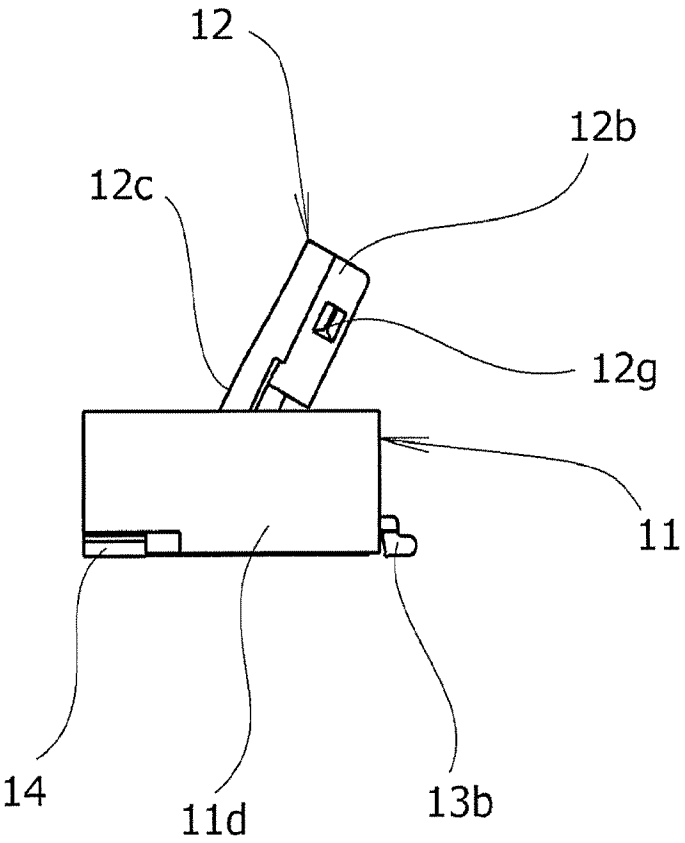
FIG. 9 is a lateral explanatory view of the electric connector in the actuator open state shown in FIG. 7 to FIG. 8.
Figure 10:
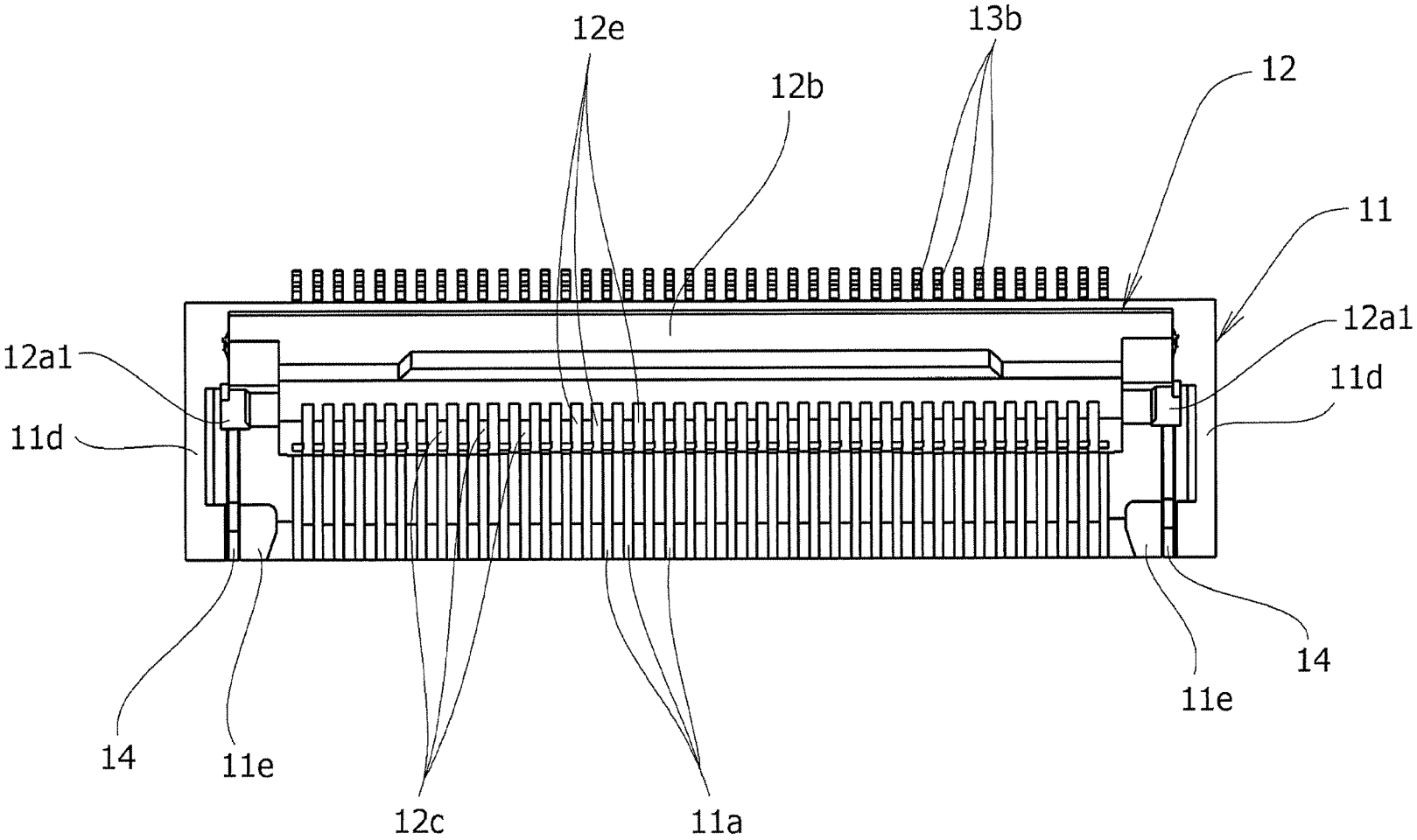
FIG. 10 is a front explanatory view of the electric connector in the actuator open state shown in FIG. 7 to FIG. 9.
Figure 11:
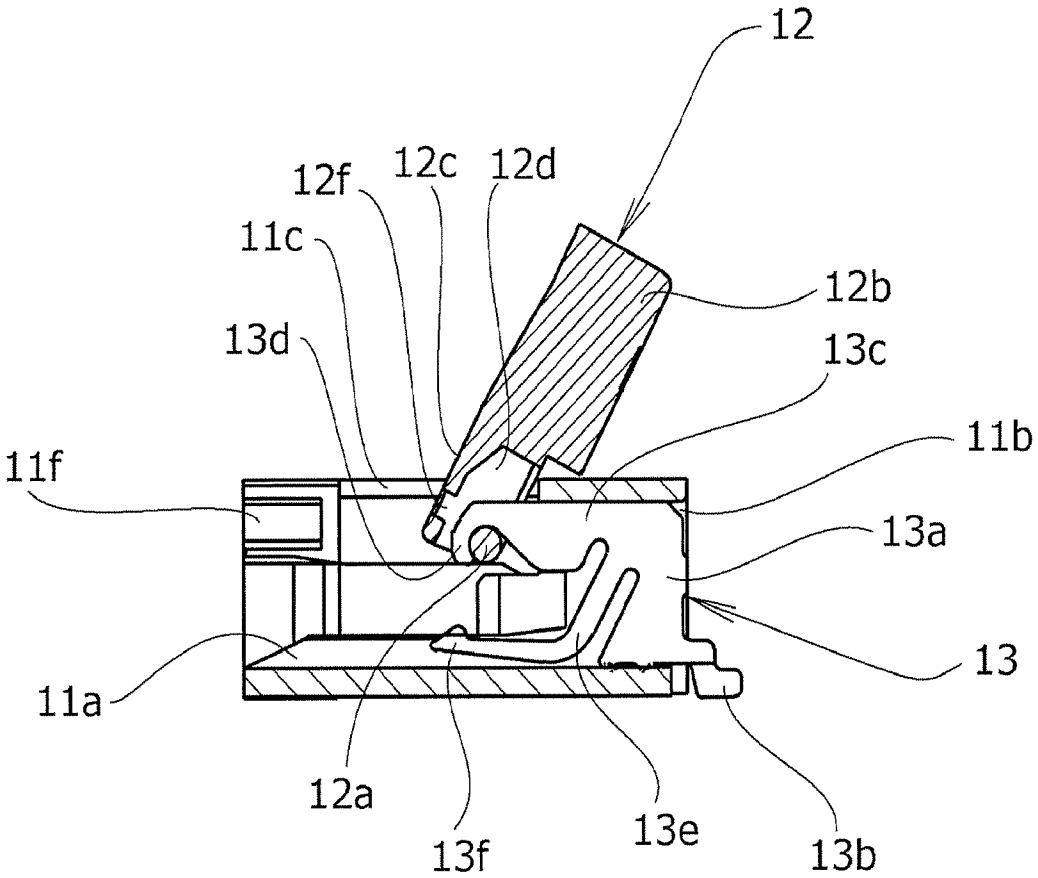
FIG. 11 is an explanatory view showing, in an enlarged manner, a transverse cross section along a line XI-XI in FIG. 8.
Figure 12:
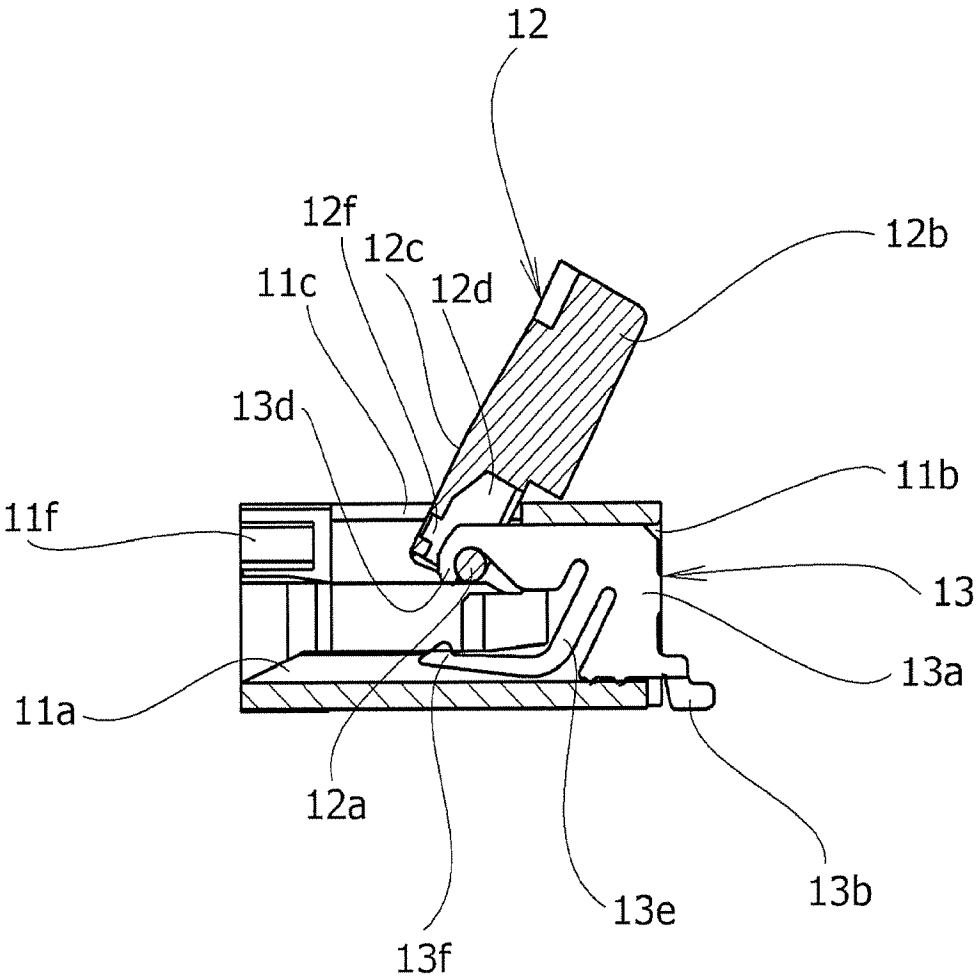
FIG. 12 is an explanatory view showing, in an enlarged manner, a transverse cross section along a line XII-XII in FIG. 8.
Figure 13:
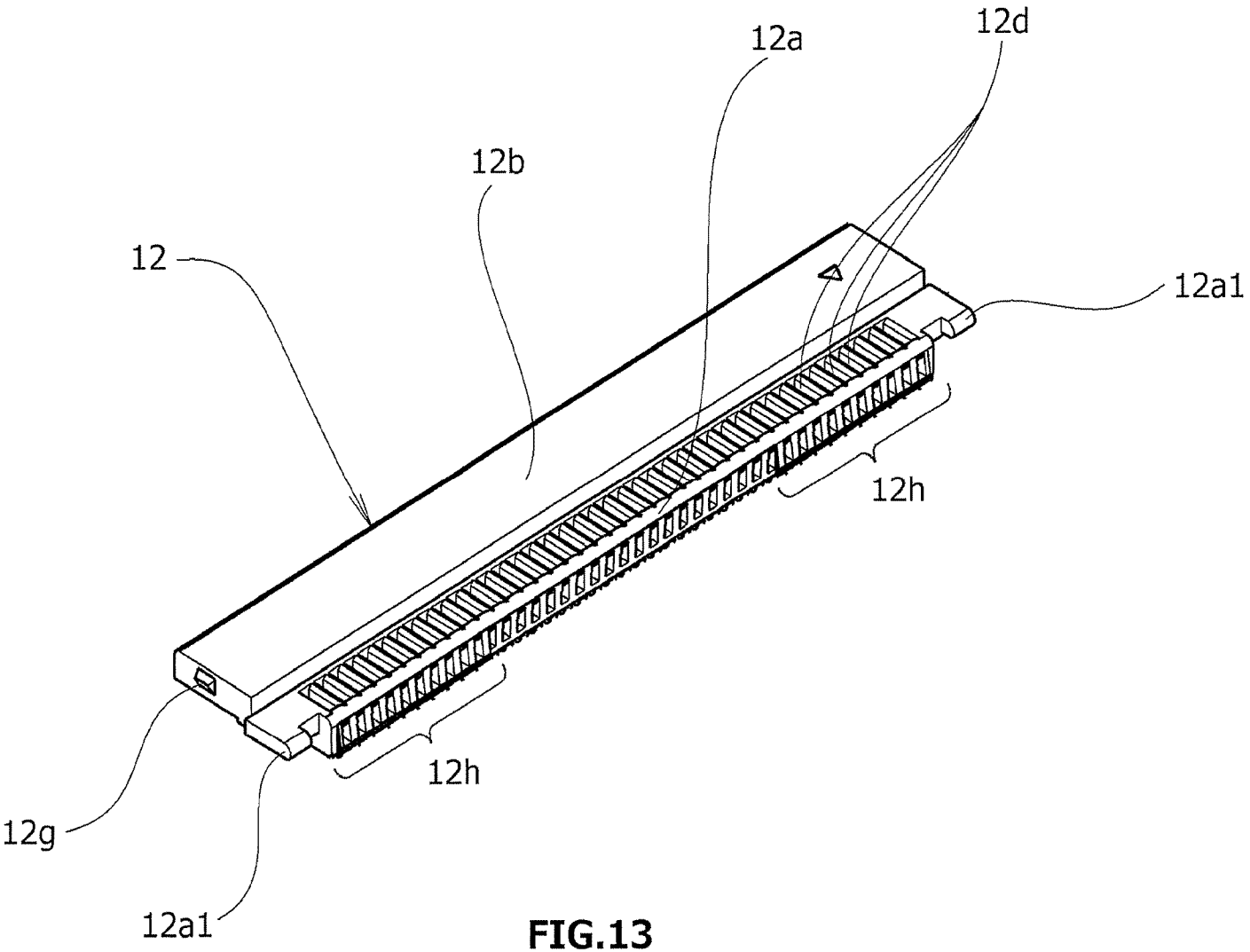
FIG. 13 is an external perspective explanatory view showing the actuator used in the electric connector shown in FIG. 1 to FIG. 12.
Figure 14:
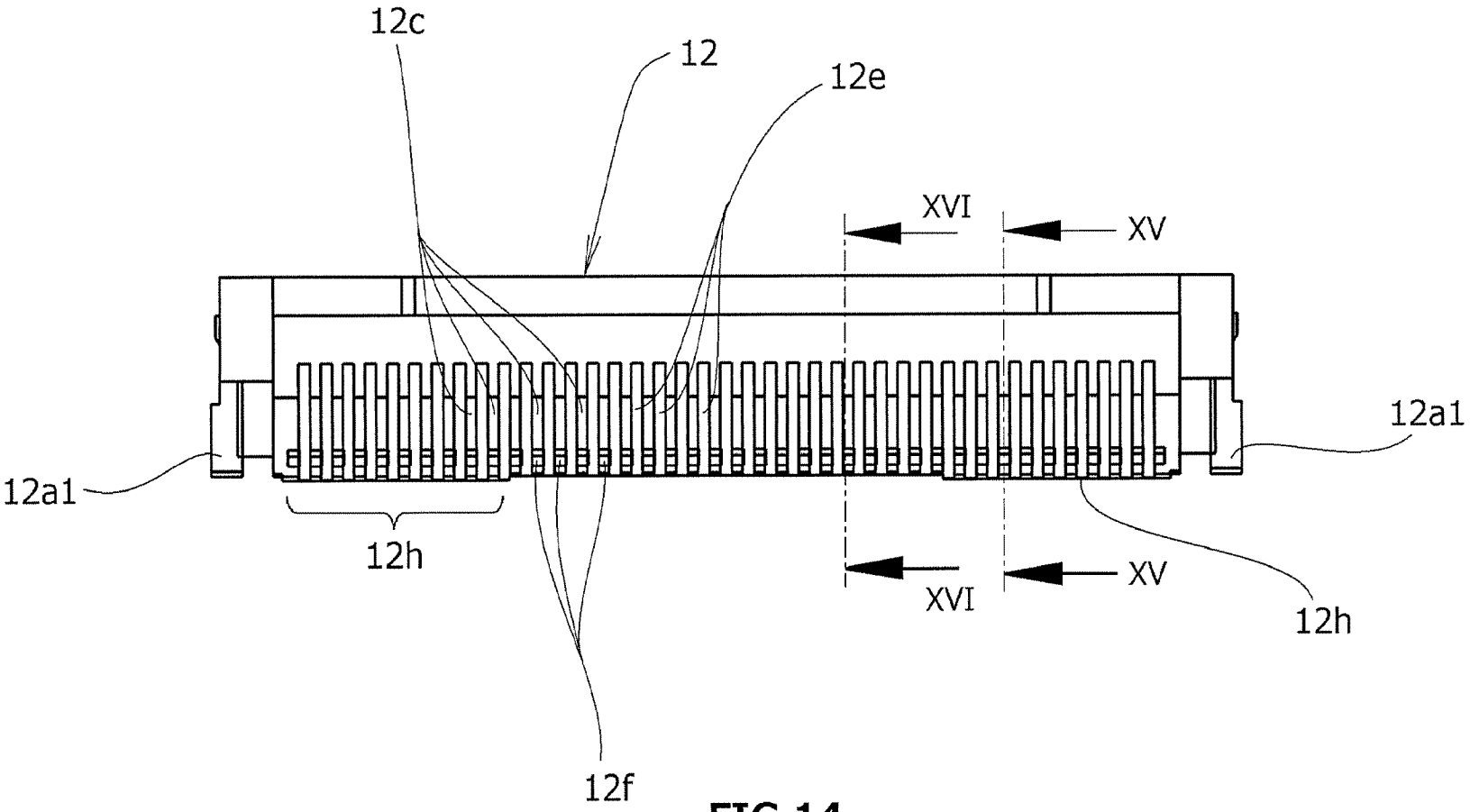
FIG. 14 is a front explanatory view of the actuator shown in FIG. 13.
Figure 15:
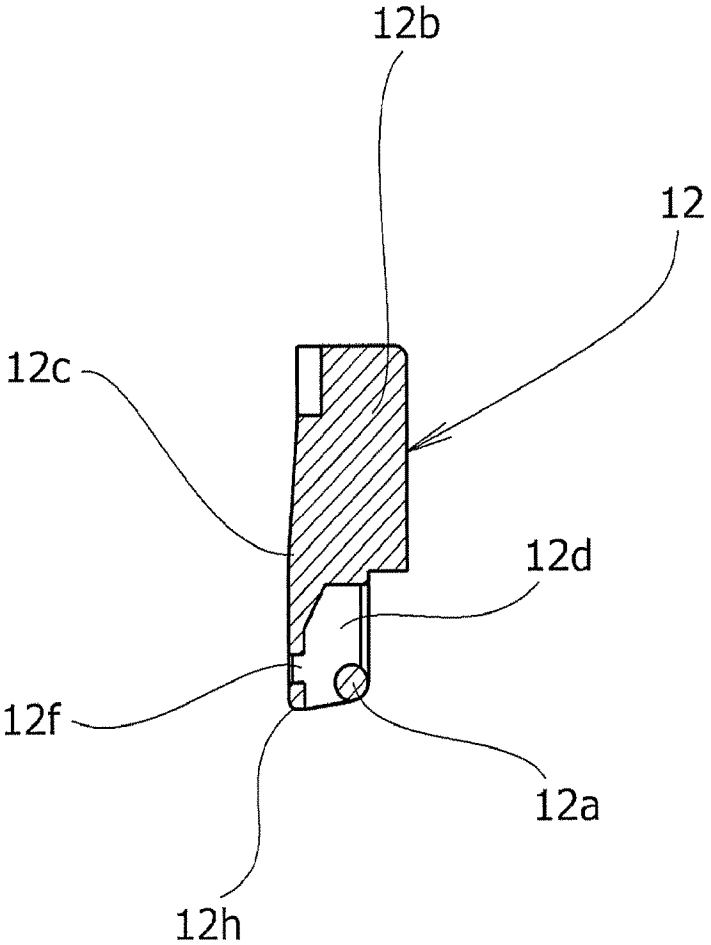
FIG. 15 is an explanatory view showing, in an enlarged manner, a transverse cross section along a line XV-XV in FIG. 14.
Figure 16:
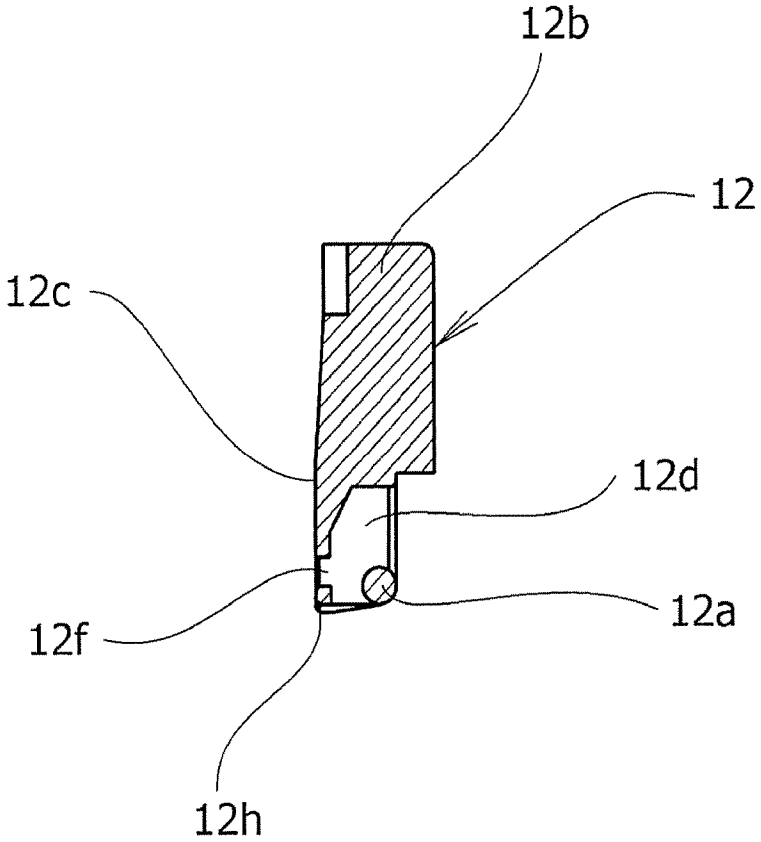
FIG. 16 is an explanatory view showing, in an enlarged manner, a transverse cross section along a line XVI-XVI in FIG. 14.
Figure 17:
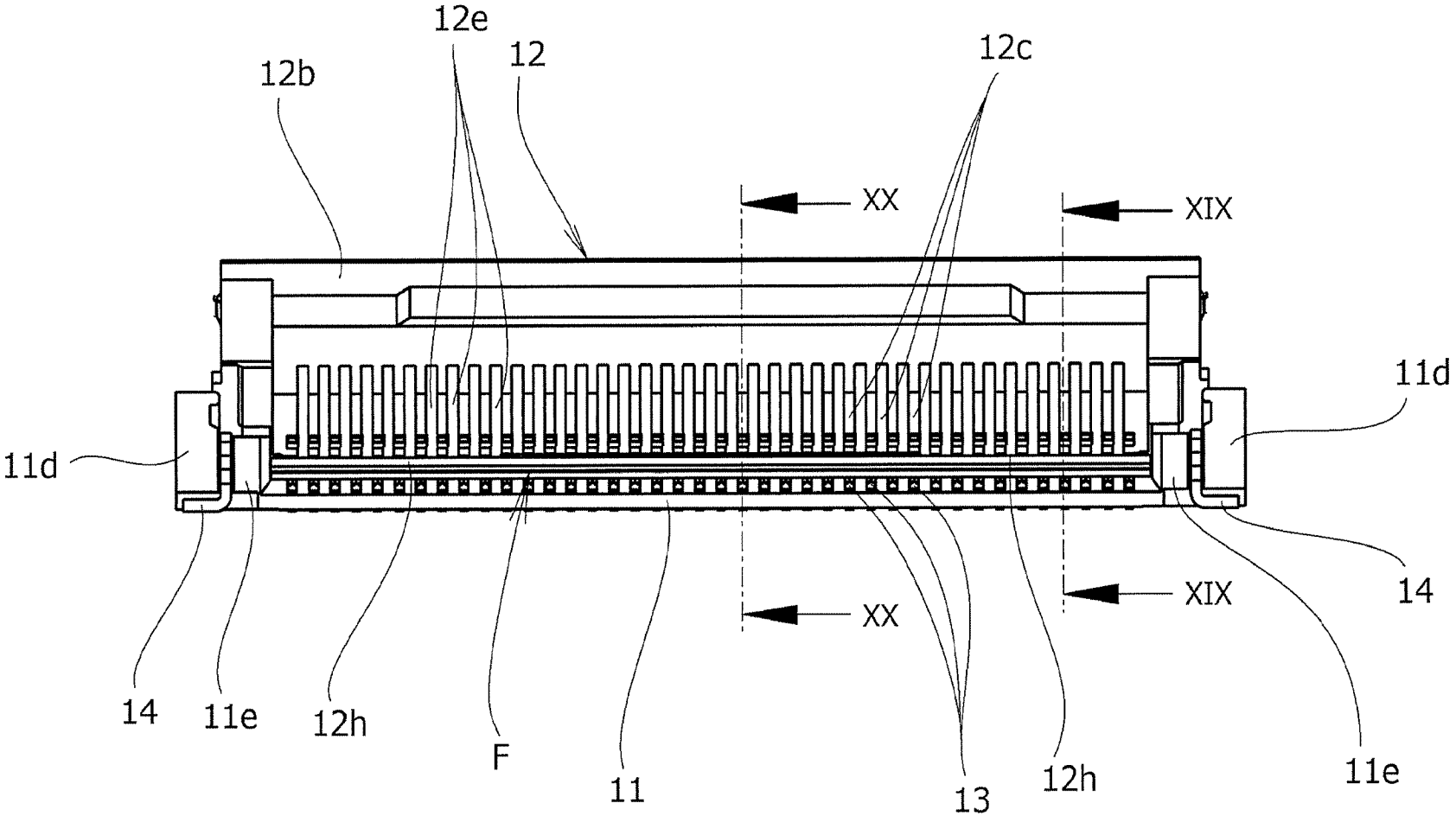
FIG. 17 is a front explanatory view showing the electric connector in a state in which pre-pressing protruding portions of the actuator have started contacting the plate-shaped signal transmission medium while the actuator is being subjected to a closing turning operation after a terminal part of the plate-shaped signal transmission medium is inserted.
Figure 18:
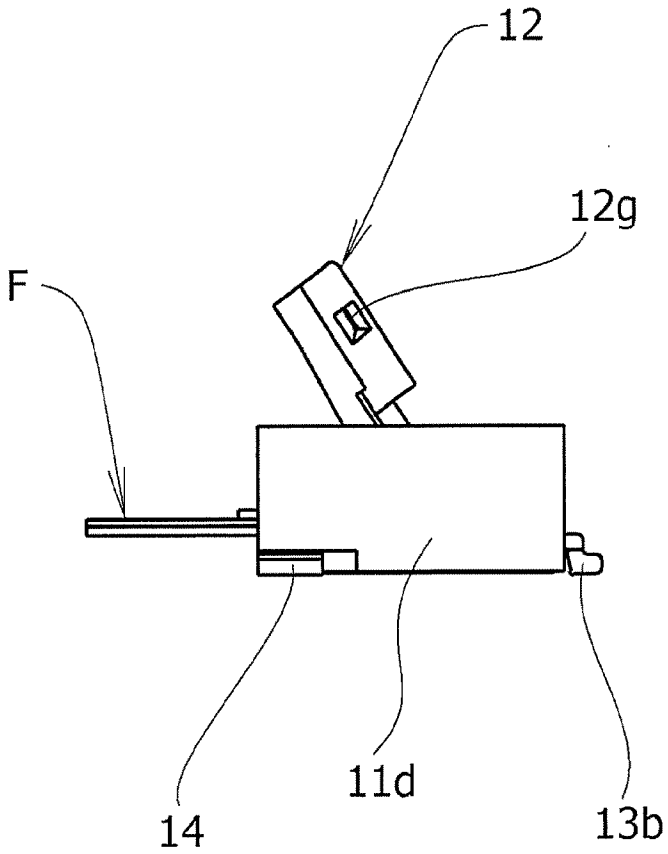
FIG. 18 is a lateral explanatory view of the electric connector shown in FIG. 17.
Figure 19:
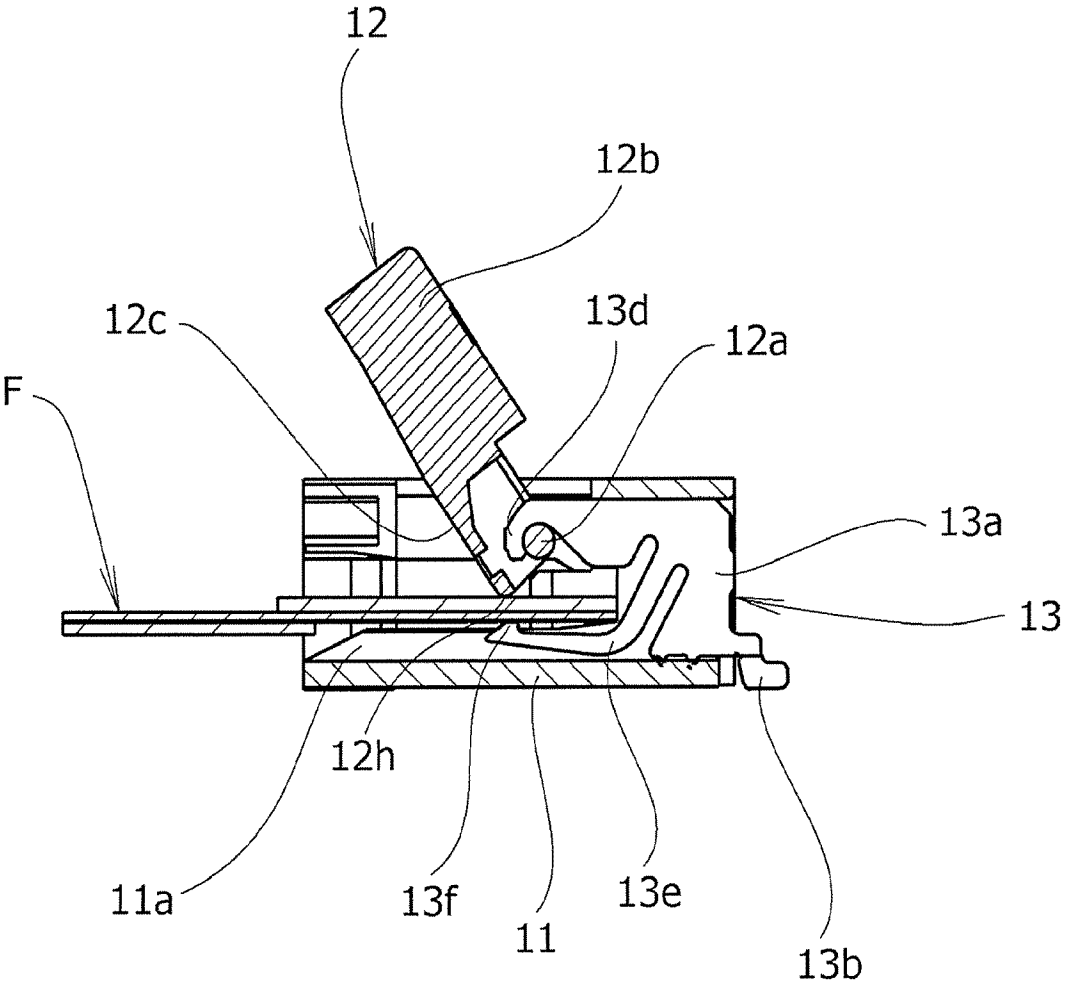
FIG. 19 is an explanatory view showing, in an enlarged manner, a transverse cross section along a line XIX-XIX in FIG. 17.
Figure 20:
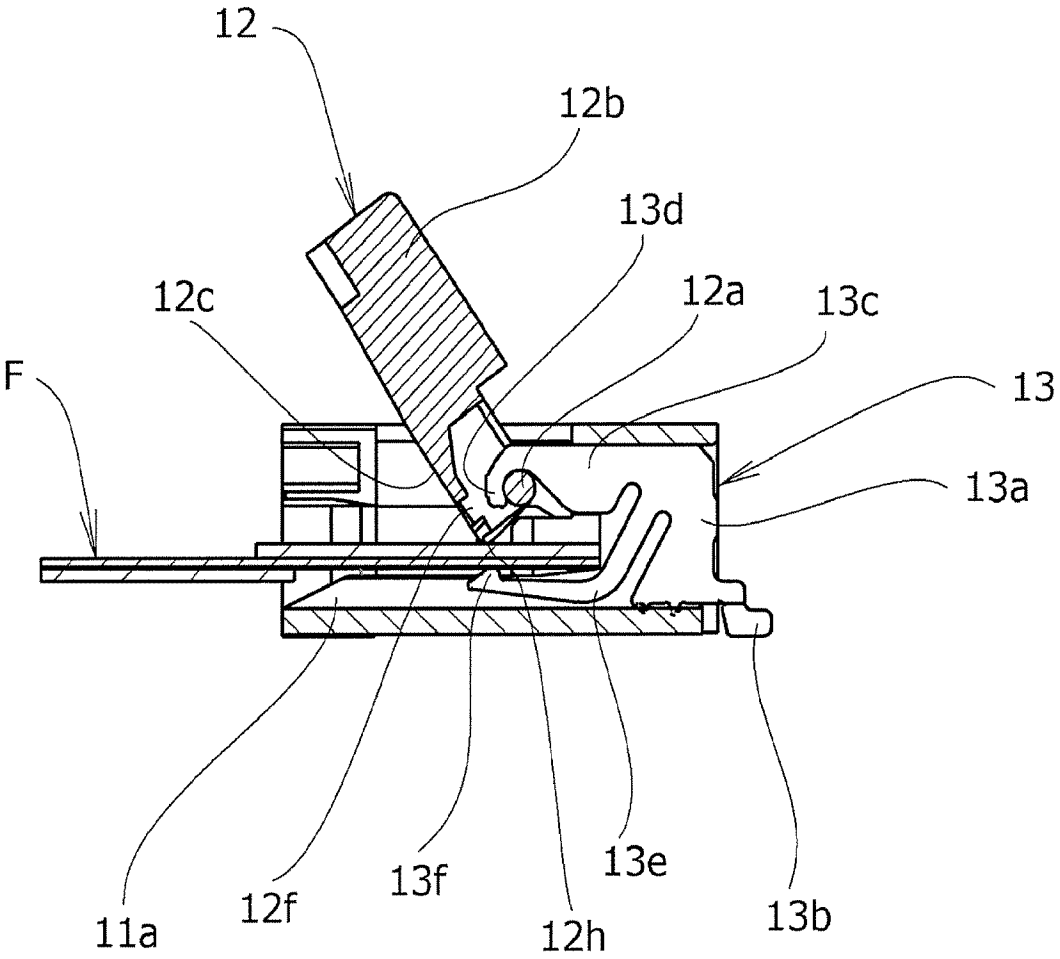
FIG. 20 is an explanatory view showing, in an enlarged manner, a transverse cross section along a line XX-XX in FIG. 17.
Figure 21:
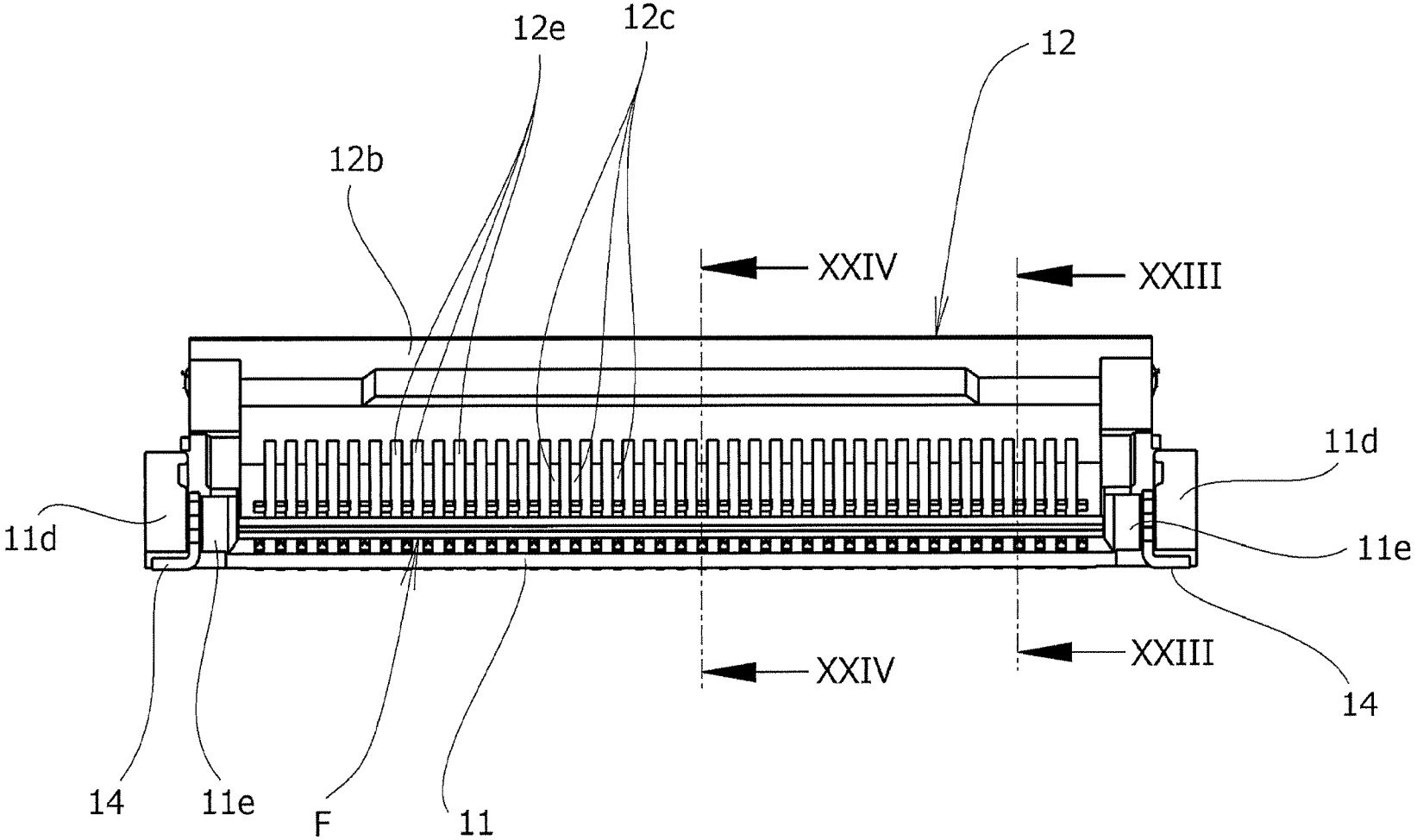
FIG. 21 is a front explanatory view showing the electric connector in a state in which medium pressing portions of the actuator have started contacting the plate-shaped signal transmission medium while the actuator is being subjected to the closing turning operation.
Figure 22:
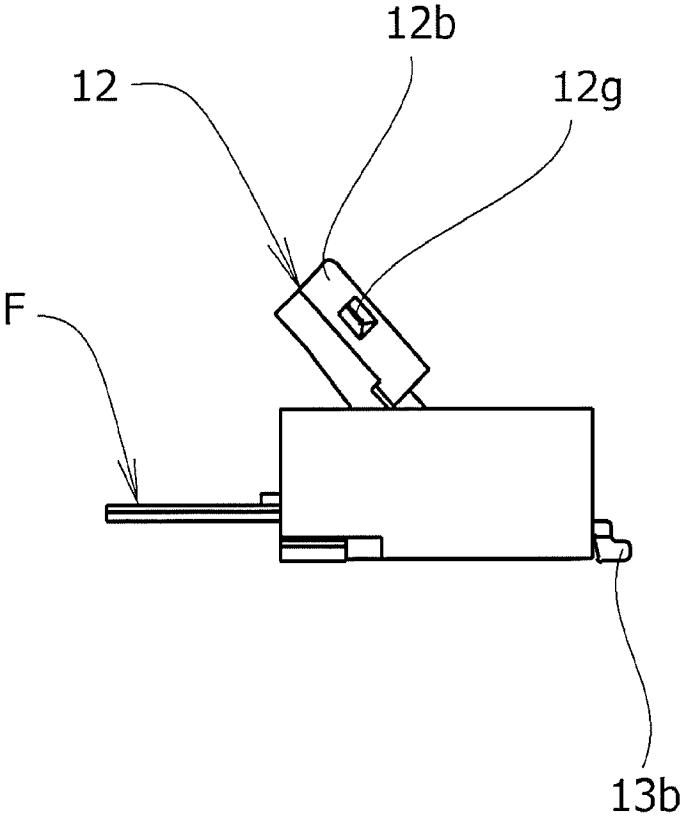
FIG. 22 is a lateral explanatory view of the electric connector shown in FIG. 21.
Figure 23:
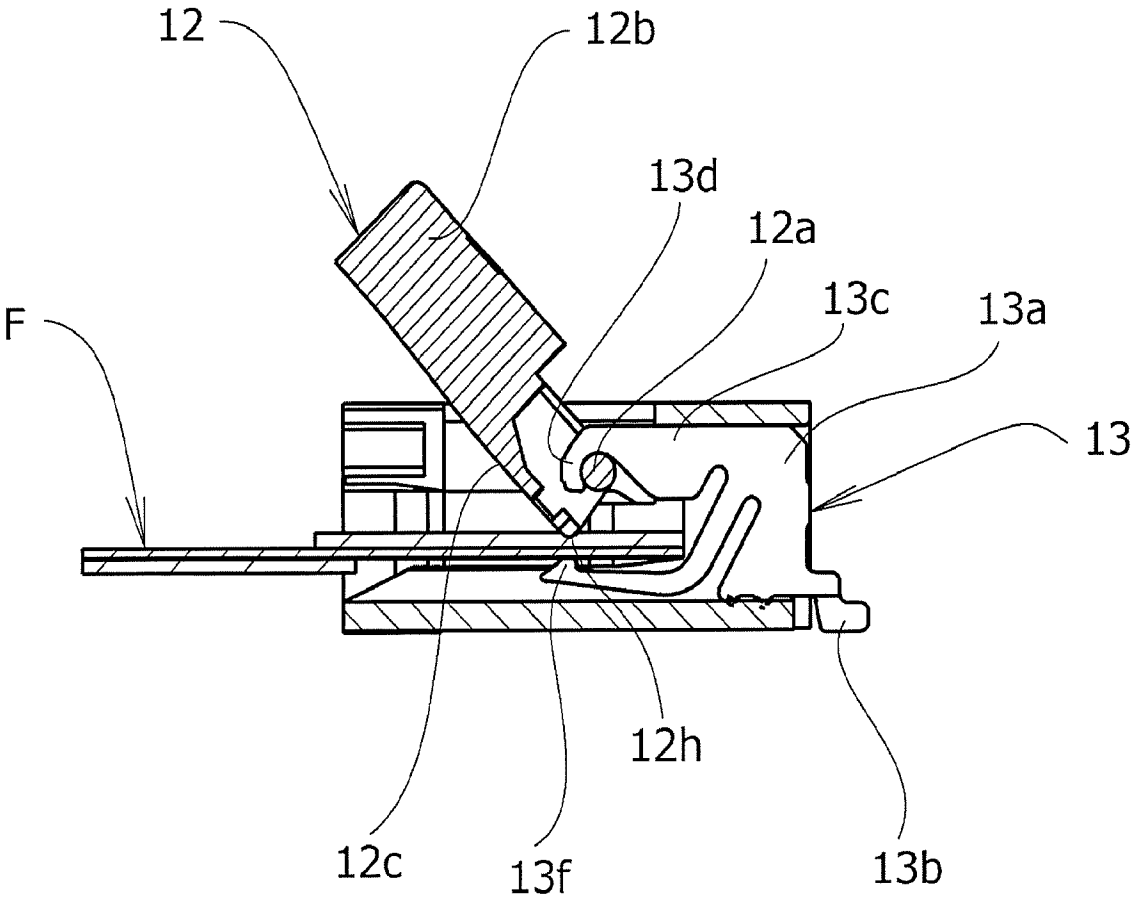
FIG. 23 is an explanatory view showing, in an enlarged manner, a transverse cross section along a line XXIII-XXIII in FIG. 21.
Figure 24:
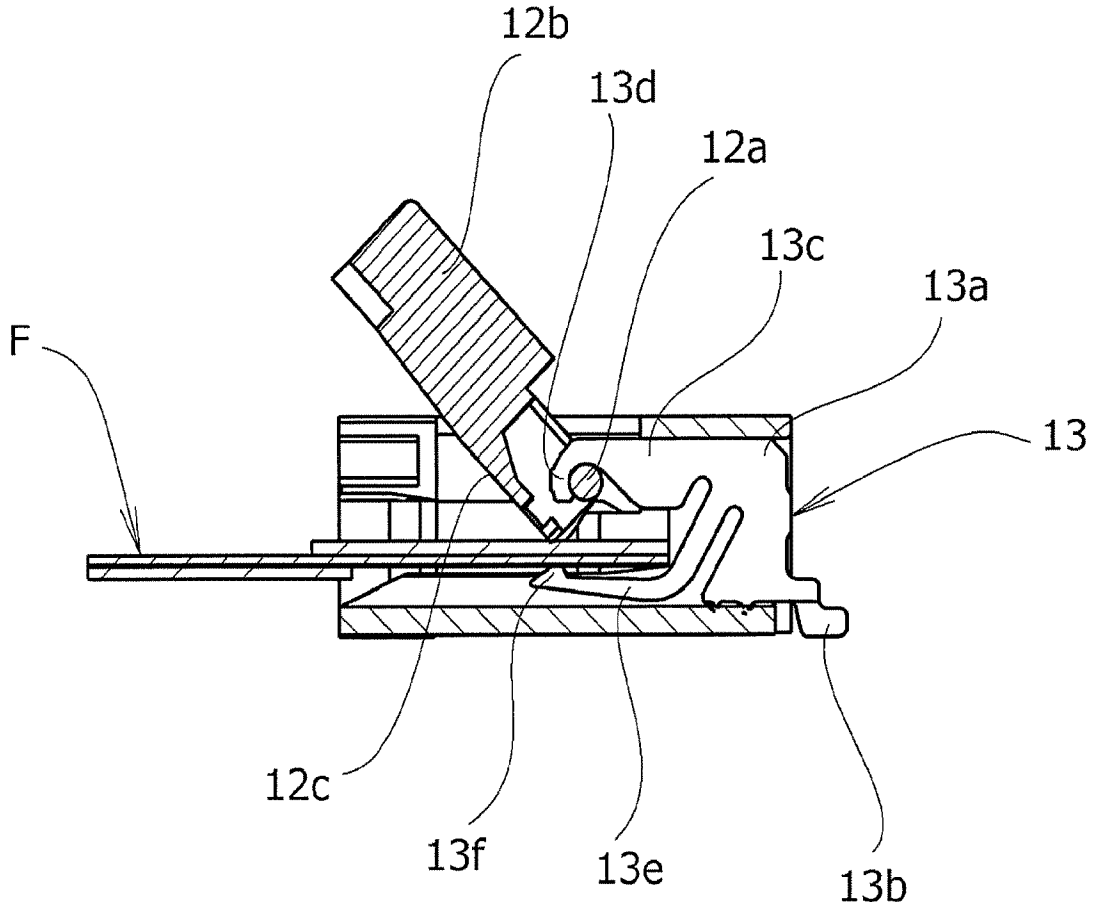
FIG. 24 is an explanatory view showing, in an enlarged manner, a transverse cross section along a line XXIV-XXIV in FIG. 21.
Figure 25:
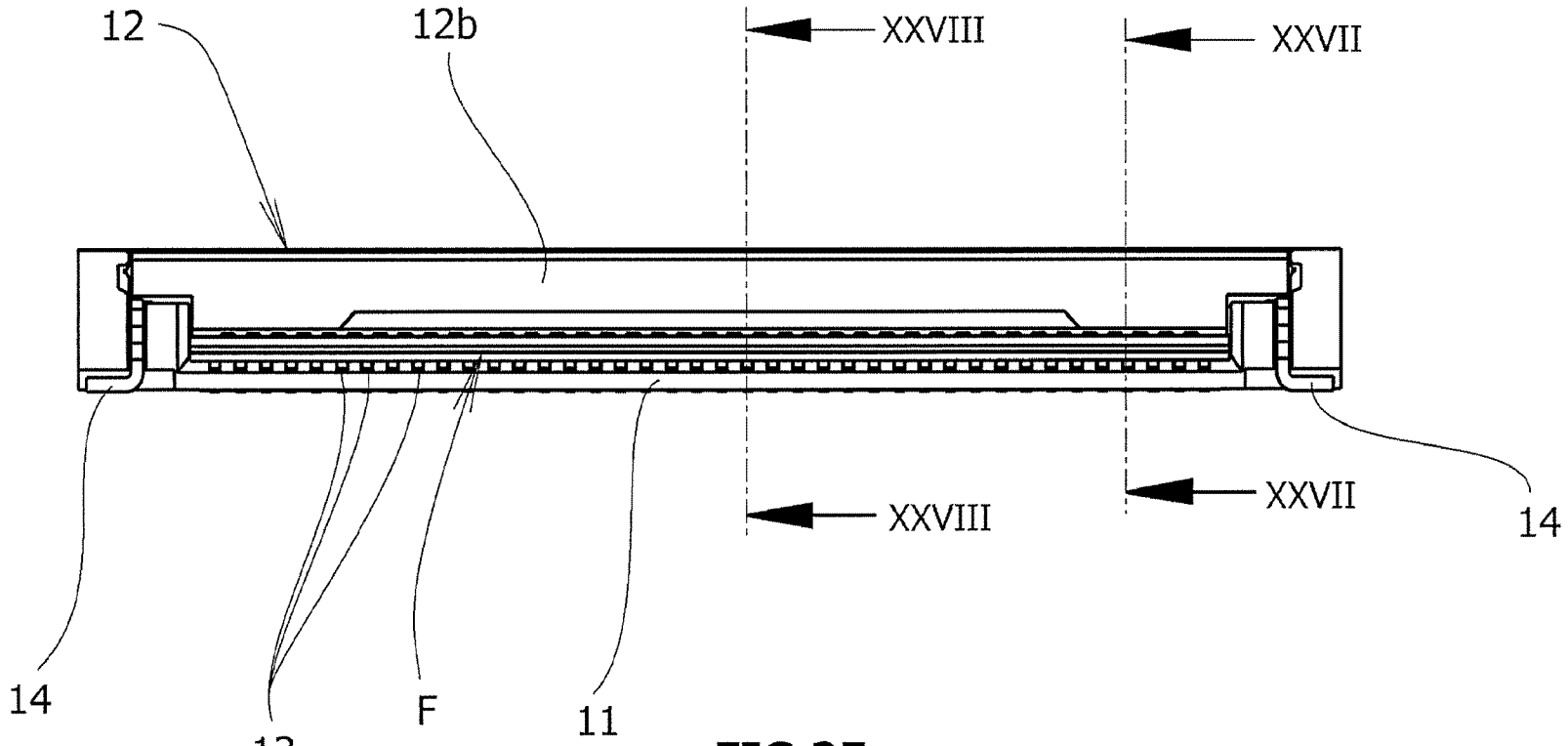
FIG. 25 is a front explanatory view showing the electric connector in a state in which the actuator has been subjected to the closing turning operation to the acting position (connected position) after the terminal part of the plate-shaped signal transmission medium is inserted.
Figure 26:
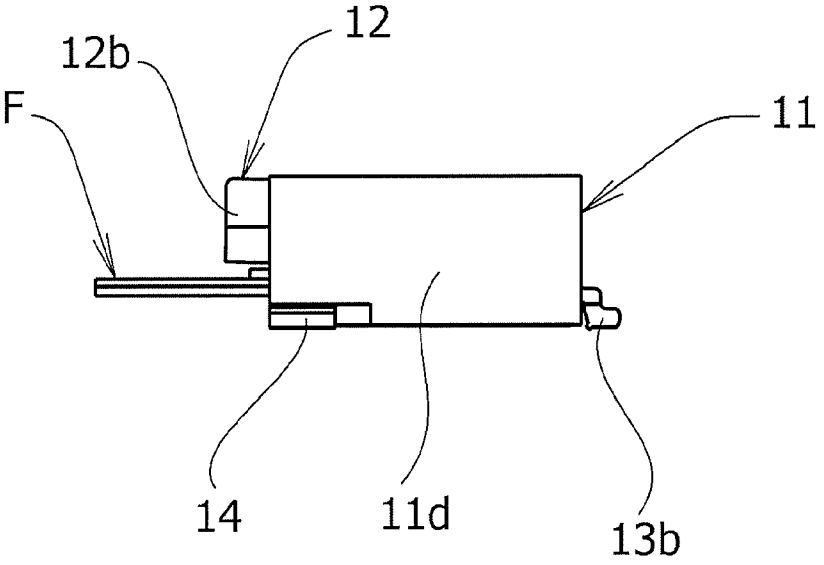
FIG. 26 is a lateral explanatory view of the electric connector shown in FIG. 25.
Figure 27:
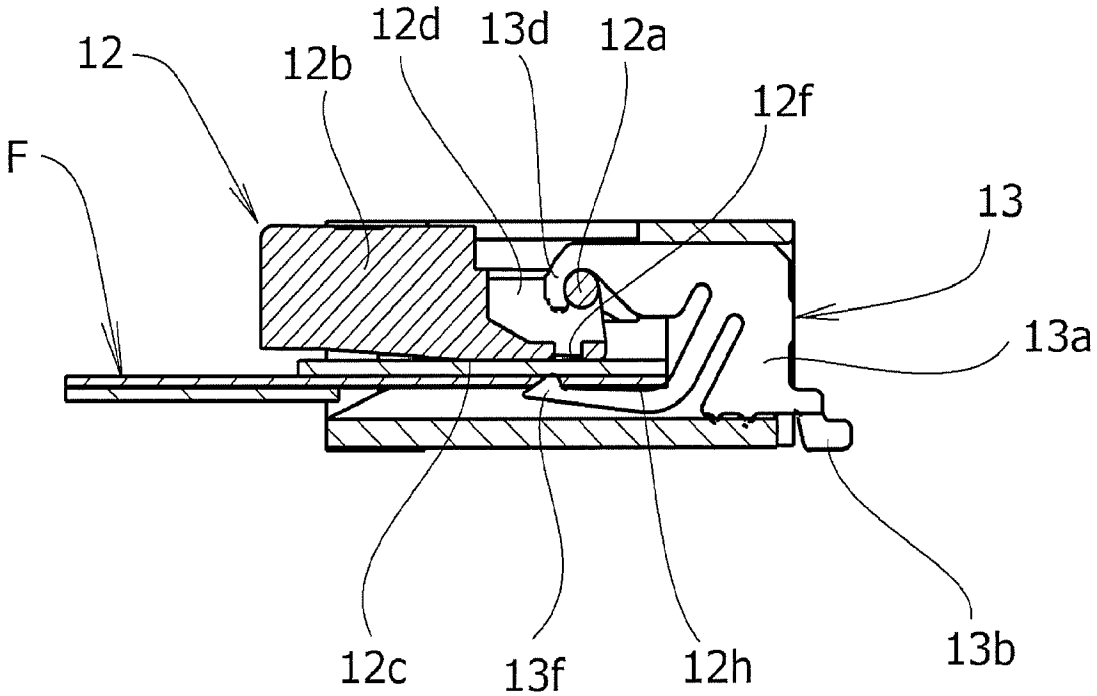
FIG. 27 is an explanatory view showing, in an enlarged manner, a transverse cross section along a line XXIII-XXIII in FIG. 25.
Figure 28:
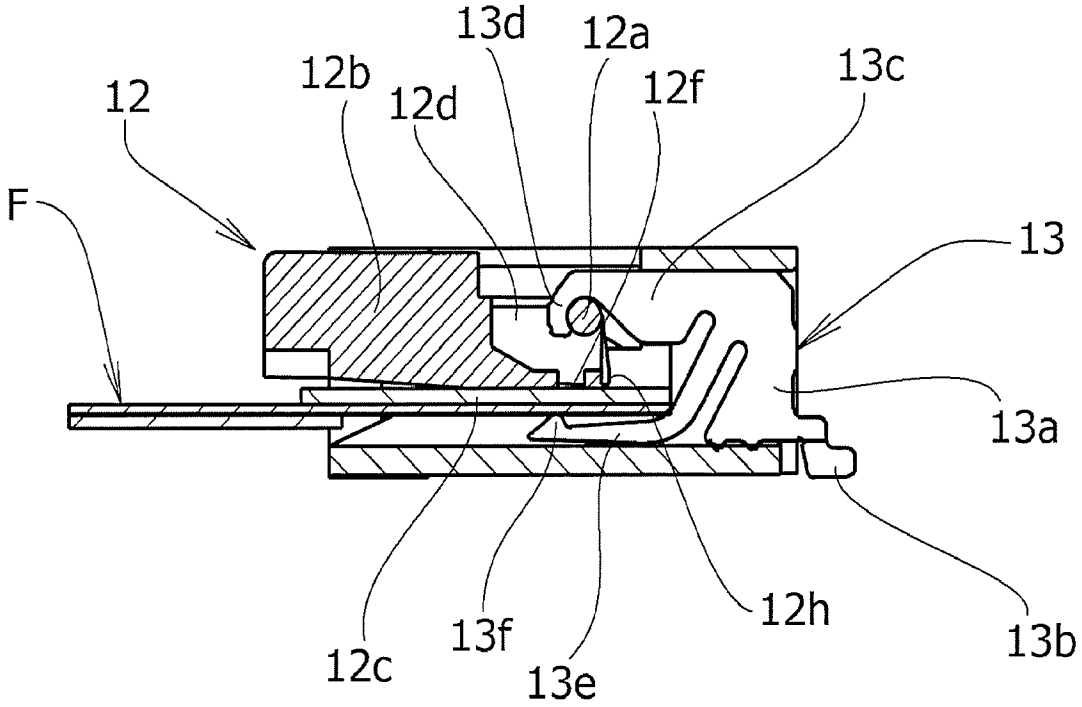
FIG. 28 is an explanatory view showing, in an enlarged manner, a transverse cross section along a line XXIV-XXIV in FIG. 25.

Meanwhile, the actuator 12 serving as the connection operating means is attached to the front edge part (left edge part in FIG. 5 and FIG. 6) of the insulating housing 11 as described above; wherein, as shown in FIG. 7, the actuator 12 is configured to be subjected to a turning operation so as to be lifted to an upper side. When the actuator 12 is subjected to the turning operation to the upper side in such a manner, the front edge part of the insulating housing 11 is caused to be in an open state across approximately the entire length thereof in the connector longitudinal direction (see FIG. 7). The terminal part of the plate-shaped signal transmission medium F composed of a flexible printed circuit (FPC), a flexible flat cable (FFC), or the like is inserted from the front edge part of the insulating housing 11 in the open state to the hollow-shape interior space of the insulating housing 11.

Moreover, in a rear edge part (right edge part in FIG. 5 and FIG. 6) of the above described insulating housing 11, a plurality of part attachment openings 11*b*, 11*b*, and so on for attaching the electrically-conductive members 13, etc. to the interior of the insulating housing 11 are provided so as to be juxtaposed at certain intervals along the connector longitudinal direction. These part attachment openings 11*b* respectively correspond to rear-end openings of the above described contact attachment grooves 11*a*, and the electrically-conductive contact members 13 inserted in the insulating housing 11 through the part attachment openings 11*b* are inserted so as to slide along the contact attachment grooves 11*a* to predetermined positions and are fixed in the inserted state.

As described above, the plurality of electrically-conductive contact members 13 are attached so as to form the multipolar shapes in the connector longitudinal direction, and the electrically-conductive contact members 13 are disposed at the positions corresponding to a wiring pattern (illustration omitted) of the plate-shaped signal transmission medium (for example, FPC or FFC) F inserted in the hollow interior space of the insulating housing 11 from the connector front side. The wiring pattern formed on the plate-shaped signal transmission medium F is a wiring pattern in which signal-transmitting electrically-conductive paths (signal-line pads) or shielding electrically-conductive paths (shield-line pads) are disposed at appropriate pitch intervals.

[About Contact Members]

Herein, each of the above described electrically-conductive contact members 13 has a rear-end base portion 13*a* fixed so as to be sandwiched by inner wall surfaces of upper and lower wall portions, which form the part attachment opening 11*b* of the insulating housing 11. At a lower end portion of the rear-end base portion 13*a*, a board connecting portion 13*b* extending so as to form a step shape toward an outer side of the connector rear side is continuously provided. The board connecting portion 13*b* is connected to the electrically-conductive path (illustration omitted) on the printed wiring board by solder joining, and the electric connector 1 is mounted by this solder joining.

Furthermore, a supporting beam 13*c* is approximately horizontally extending toward the connector front side from an upper end part of the rear-end base portion 13*a*, which constitutes the above described electrically-conductive contact member 13. In a state in which the supporting beam 13*c* is abutting the inner surface of the upper wall portion forming the interior space of the insulating housing 11, the supporting beam 13*c* is extending to an approximately central part thereof in the connector front-rear direction. An extending end part of the supporting beam 13*c* is exposed to the upper side through a central opening 11*c* provided in the insulating housing 11.

More specifically, the central opening 11*c* of the above described insulating housing 11 is formed so as to cut out part of the upper wall portion of the insulating housing 11 that is in the front side of the central part thereof in the connector front-rear direction, and the central opening 11*c* is provided across the entire length excluding lateral wall portions 11*d* and 11*d* provided at connector-longitudinal-direction both end portions. In a front-side region of the central opening 11*c*, the above described actuator (connection operating means) 12 is disposed; and, in a rear-side region of the central opening 11*c*, front-end-side parts of the supporting beams 13*c* constituting the electrically-conductive contact members 13 are disposed so as to be exposed to the upper side as described above.

Moreover, in front end parts of the lateral wall portions 11*d* and 11*d* of the insulating housing 11, latched portions 11*f* having recessed shapes are formed. The actuator 12 is configured to be maintained in a horizontally pushed-down state as shown in FIG. 1 to FIG. 6 and FIG. 25 to FIG. 28 when later-described parts of the actuator 12 are latched with respect to the latched portions 11*f*. This point will be described later in detail.

Herein, in a front end portion of the supporting beam 13*c*, a bearing portion 13*d* is formed so as to be opened toward the lower side and form a recessed shape. A turning shaft 12*a* serving as a shaft portion provided in the actuator (connection operating means) 12 is disposed so as to slidably contact, from the lower side, the bearing portion 13*d* provided in the supporting beam 13*c*, and the actuator 12 is configured to be turned about the turning shaft (shaft portion) 12*a*. The configuration of the actuator 12 will be described later in detail.

Furthermore, at an integrally coupled part of the upper end part of the rear-end base portion 13*a*, which constitutes the rear end part of each of the electrically-conductive contact member 13, and a root part of the supporting beam 13*c*, an elastic beam 13*e* is provided so as to branch therefrom. The elastic beam 13*e* is formed by a band-shaped flexible member extending to form a cantilever shape from a lower edge of the root part of the above described supporting beam 13*c* toward the obliquely lower side in the connector front side, wherein the elastic beam 13*e* is extending to the obliquely lower side to a vicinity of the inner wall surface of the lower wall portion of the insulating housing 11 and is then approximately linearly extending toward the connector front side so as to be somewhat bent upward. At an extending-side front end part of the elastic beam 13*e*, a contact-point portion 13*f* is formed so as to form an upward projection shape.

The contact-point portion 13*f* provided on the elastic beam 13*e*, which forms part of the electrically-conductive contact member 13, is in a disposition relation in which the contact-point portion 13*f* faces, from the lower side, the wiring pattern (illustration omitted) of the plate-shaped signal transmission medium (for example, FPC or FFC) F inserted in the insulating housing 11. The wiring pattern of the plate-shaped signal transmission medium F is configured to be pressed against, from the upper side, the contact-point portion 13*f* of the electrically-conductive contact member 13 when the plate-shaped signal transmission medium F is pressed toward the lower side by the actuator (connection operating means) 12 operated to be turned.

[About Actuator]

Herein, the actuator (connection operating means) 12, which is operated to be turned about the turning shaft (shaft portion) 12*a* in the above described manner, has an operation main-body portion 12*b* composed of a plate-shaped member extending in the connector longitudinal direction. The plate-shaped member constituting the operation main-body portion 12 is provided with a pair of edge portions extending approximately in parallel to the connector longitudinal direction, and the above described turning shaft 12*a* is extending so as to be along one of the edge portions.

Longitudinal-direction both-side shaft-end parts of the turning shaft (shaft portion) 12*a* are formed in shaft-end supporting portions 12*a*1, which are projecting from connector-longitudinal-direction both end surfaces of the operation main-body portion 12*b* to the outer side. The both shaft-end supporting portions 12*a*1 and 12*a*1 are slidably supported from the lower side by upper edge portions of retaining metal fittings 14, which are disposed along the inner surface sides of the lateral wall portions 11*d* and 11*d* of the insulating housing 11, so as to support the turning shaft 12*a* so that the turning shaft 12*a* does not fall from the bearing portions 13*d* of the electrically-conductive contact members 13 to the lower side. The turning operation force of an operator is configured to be applied to an outer part of the turning radius about the turning shaft (shaft portion) 12*a* like this.

Note that lower edge parts of the above described retaining metal fittings 14 are configured to be placed on the illustration-omitted printed wiring board and mounted thereon by solder joining.

Furthermore, a front end part of the operation main-body portion 12*b* in the state in which the actuator (connection operating means) 12 is horizontally pushed down is provided with latch portions 12*g*, which are formed so as to form projecting shapes toward the outer side in the connector longitudinal direction. The latch portions 12*g* provided on the actuator 12 are configured to be mated with the latched portions 11*f* in the insulating housing 11 side when the actuator 12 is turned so as to be horizontally pushed down. When both of the members 12*g* and 11*f* are mated with each other, the actuator 12 is maintained in the horizontally pushed-down state (see FIG. 1 to FIG. 6 and FIG. 25 to FIG. 28).

More specifically, in the horizontally pushed-down state, the actuator (connection operating means) 12 is disposed so as to close the front-side region of the central opening 11*c* of the above described insulating housing 11, and an opening turning operation of the actuator 12 is configured to be carried out from such "acting position (closed position)" at which the actuator 12 is horizontally pushed down by a closing turning operation of the actuator 12 to "standby position (open position)" at which the actuator 12 is lifted to the upper side as shown in FIG. 7 to FIG. 12. The actuator 12 subjected to the opening turning operation to the "standby position (open position)" abuts part of the insulating housing 11 and stops turning in a state in which the actuator 12 is pushed down somewhat to the rear side from an upright state.

When the actuator (connection operating means) 12 is subjected to the opening turning operation in this manner so as to be lifted to the "standby position (open position)" (see FIG. 7 to FIG. 12), the front-end-side region of the insulating housing 11 is caused to be in a state open to the upper side so that the terminal part of the plate-shaped signal transmission medium (for example, FPC or FFC) F is placed from the upper side with respect to the front-end-side region of the insulating housing 11, which has been caused to be the open state.

The terminal part of the plate-shaped signal transmission medium (for example, FPC or FFC) F placed in the front-end-side region of the insulating housing 11 is inserted toward the connector front side (right side in FIG. 17 to FIG. 28) and is stopped in a state in which the medium F is abutting the wall portion of the insulating housing 11. Herein, at both-side edge portions of the terminal part of the plate-shaped signal transmission medium F, illustration-omitted positioning latch plates are provided so as to bulge to both-side outer sides. When the both-side positioning latch plates abut lock plates 11*e* and 11*e*, which are disposed at longitudinal-direction both-side parts of the insulating housing 11 and mutually opposed, movement in the extending direction of the plate-shaped signal transmission medium F is restricted, thereby positioning the plate-shaped signal transmission medium F.

Then, when the actuator (connection operating means) 12 which has been at the "standby position (open position)" is subjected to the closing turning operation so as to be pushed down to the connector front side and moved (turned) to the "acting position (closed position)" as shown in FIG. 25 to FIG. 28, the latch portions 12*g*, which are provided so as to form projecting shapes on the operation main-body portion 12*b* in the above described manner, are latched with the latched portions 11*f* of the insulating housing 11 and are retained at the "acting position (closed position)".

As described later, medium pressing portions 12*c* are formed on the surface corresponding to the lower surface of the actuator (connection operating means) 12 which has been moved (turned) to the "acting position (closed position)". The medium pressing portions 12*c* are configured to press an upper surface (first surface) of the plate-shaped signal transmission medium (for example, FPC or FFC) F toward the lower side and press the wiring pattern, which is provided on the plate-shaped signal transmission medium F, against the contact-point portions 13*f* of the electrically-conductive contact members 13. This point will be described later in detail.

Moreover, as shown particularly in FIG. 13 to FIG. 16, in the operation main-body portion 12*b* of the actuator (connection operating means) 12, a plurality of bearing housing portions 12*d* composed of spaces which house the bearing portions 13*d* of the supporting beams 13*c*, which are part of the above described electrically-conductive contact members 13, are provided in a recessed manner so as to form comb-teeth shapes. These bearing housing portions 12*d* are disposed at the same positions as the above described electrically-conductive contact members 13 in the connector longitudinal direction (the direction of the multipolar arrangement) and are disposed so that the bearing portions 13*d* of the supporting beams 13*c* are inserted in the bearing housing portions 12*d* of the actuator 12. The turning shaft 12*a* of the actuator (connection operating means) 12 is disposed to contact the bearing portions 13*d* of the supporting beams 13*c* so as to be pressed thereagainst from the lower side as described above so that the actuator 12 is configured to be turnably retained.

On the other hand, as described above, on the operation main-body portion 12*b* of the actuator (connection operating means) 12, the plurality of medium pressing portions 12*c*, which press the upper surface (first surface) of the plate-shaped signal transmission medium (for example, FPC or FFC) F, are formed at the positions corresponding to the electrically-conductive contact members 13. The plurality of medium pressing portions 12*c* are formed on the surface corresponding to the lower surface of the actuator 12 which has been moved (turned) to the "acting position (closed position)", and the medium pressing portions 12*c* are formed by protruding linear portions disposed at predetermined pitch intervals in the connector longitudinal direction, which is the multipolar arrangement direction of the electrically-conductive contact members 13. Each of the protruding linear portions, which form the medium pressing portions 12*c*, is slenderly extending along the turning radius direction of the actuator 12 and is formed so that the transverse sectional shape thereof along the direction of the multipolar arrangement (connector longitudinal direction) forms an approximately rectangular shape.

On the other hand, in the part between each pair of medium pressing portions 12*c* and 12*c*, which are provided so as to be adjacent to each other in the direction of multipolar arrangement (connector longitudinal direction), a groove portion 12*e* slenderly extending similarly along the turning radius direction of the actuator (connection operating means) 12 is provided in a recessed manner. Each of the groove portions 12*e* is formed so that the transverse sectional shape thereof along the direction of multipolar arrangement (connector longitudinal direction) forms an approximately rectangular shape and is configured to be in a state in which the groove portion 12*e* is not contacting the upper surface (first surface) of the plate-shaped signal transmission medium (for example, FPC or FFC) F in the state in which the actuator 12 is turned to the "acting position (closed position)", wherein a pressing action with respect to the plate-shaped signal transmission medium F is not carried out.

In this manner, the medium pressing portions 12*c* provided on the actuator (connection operating means) 12 are disposed at the same positions as the electrically-conductive contact members 13 in the multipolar arrangement direction (connector longitudinal direction) of the electrically-conductive contact members 13. Therefore, when the actuator 12 disposed at the "standby position (open position)" so as to be flipped up to the upper side is subjected to a turning operation so as to be pushed down approximately horizontally toward the connector front side and is turned to the "working position (closed position)", the medium pressing portions 12*c* of the actuator 12 are in a disposition relation in which the medium pressing portions 12*c* face the electrically-conductive contact members 13 from immediately above.

More specifically, when the actuator (connection operating means) 12 is subjected to the closing turning operation to the "acting position (closed position)" (see FIG. 25 to FIG. 28) in the state in which the terminal part of the plate-shaped signal transmission medium (for example, FPC or FFC) F is inserted in the insulating housing 11 (see FIG. 17 to FIG. 28), the medium pressing portions 12*c* of the actuator 12, which are formed by the slender protruding linear portions as described above, press the upper-side surface (first surface) of the plate-shaped signal transmission medium F toward the lower side. As a result, the wiring pattern provided in a lower surface (second surface) side of the plate-shaped signal transmission medium F is pressed in a pressurized contact state against the contact-point portions 13*f* of the electrically-conductive contact members 13.

On the other hand, even in the state in which the actuator (connection operating means) 12 is turned to the "acting position (closed position)", the groove portions 12*e* each provided in the part between the pair of medium pressing portions 12*c* and 12*c*, which are adjacent to each other in the direction of multipolar arrangement (connector longitudinal direction), are maintained in the state in which the groove portions 12*e* are not in contact with the surface of the plate-shaped signal transmission medium (for example, FPC or FFC) F. As a result of providing the groove portions 12*e* like this, elastically deformed portions of the plate-shaped signal transmission medium F are housed in the space of the groove portions 12*e*, and the retaining force in the direction of multipolar arrangement with respect to the plate-shaped transmission medium F is improved.

Furthermore, in part of each of the medium pressing portions 12*c* provided in the actuator (connection operating means) 12, a deformation allowing portion 12*f* is provided so as to communicate from the outer surface of the medium pressing portion 12*c* to the above described bearing housing portion 12*d*. The deformation allowing portion 12*f* is composed of a penetrating hole formed at a position somewhat in the rear side of the immediately-above position of the contact-point portion 13*f* of the electrically-conductive contact member 13 in the state in which the actuator (connection operating means) 12 is turned to the "acting position (closed position)". The elastically deformed portion of the plate-shaped signal transmission medium F in the case in which the medium pressing portion 12*c* of the actuator 12 presses the plate-shaped signal transmission medium (for example, FPC or FFC) F in the above described manner is configured to be housed in the inner-side space of the above described deformation allowing portion 12*f*.

Herein, the operation main-body portion 12*b* of the above described actuator (connection operating means) 12 is provided with pre-pressing protruding portions 12*h*, which create a clicking sensation of the turning operation immediately before the plate-shaped signal transmission medium (for example, FPC or FFC) F is finally fixed. In the state in which the actuator 12 is raised to the "standby position (open position)" (see FIG. 7 to FIG. 12), the pre-pressing protruding portion 12*h* is formed so as to form a lower edge portion of the above described medium pressing portion (protruding linear portion) 12*c* and the groove portion 12*e* and is formed in a shape which is projecting toward a somewhat lower side of the turning shaft 12*a* at the front-side part of the turning shaft 12*a*.

More specifically, the pre-pressing protruding portions 12*h* are provided so as to protrude to the inner side in the turning radius direction as described above; wherein, particularly as shown in FIG. 13, the pre-pressing protruding portion 12*h* is disposed in longitudinal-direction both-side regions of the actuator (connection operating means) 12 and are not provided in a longitudinal-direction central region. Therefore, in the longitudinal-direction central region of the actuator (connection operating means) 12, turning-radius-inner-side edge parts of the medium pressing portions (protruding linear portions) 12*c* and the groove portions 12*e* are formed so as to extend to form an approximately flat-surface shape.

The pre-pressing protruding portions 12*h* are disposed in a front side (downstream side) of the medium pressing portions 12*c* in the direction of a circumferential trajectory of the closing turning operation that pushes down the actuator (connection operating means) 12, which has been at the "standby position (open position)", toward the "acting position (closed position)", and the distance (radius) thereto from the turning shaft 12*a* which is the turning center of the actuator 12 is set to be somewhat larger than the distance (radius) similarly from the turning shaft 12*a* to the medium pressing portion 12*c*.

Therefore, when the actuator (connection operating means) 12 is subjected to the closing turning operation, top portions of the pre-pressing protruding portions 12*h* are brought into pressure-contact with the surface of the plate-shaped signal transmission medium F at the timing immediately before the medium pressing portions 12*c* are pressed against the surface of the plate-shaped signal transmission medium (for example, FPC or FFC) F. Immediately after that, the pre-pressing protruding portions 12*h* are detached from the surface of the plate-shaped signal transmission medium F, and the medium pressing portions 12*c* are brought into pressure-contact with the surface of the plate-shaped signal transmission medium F. Therefore, a so-called clicking sensation and clicking sound are configured to be obtained in the closing turning operation.

The pre-pressing protruding portions 12*h* provided in this manner in downstream-side vicinity parts of the medium pressing portions 12*c* in the closing-turning-operation direction of the actuator (connection operating means) 12 are provided in partial regions in the connector longitudinal direction, which is the multipolar arrangement direction of the electrically-conductive members 13. However, they are not limited to the configuration in which the pre-pressing protruding portions 12*h* are disposed only in the longitudinal-direction both-side regions of the actuator 12 like the present embodiment, and various disposition relations can be employed, for example, a disposition configuration in which the pre-pressing protruding portions 12*h* are scattered in the longitudinal direction of the actuator 12 at intervals determined in advance.

As described above, according to the electric connector 10 according to the present embodiment, the pressing force of the pre-pressing protruding portions 12*h* with respect to the plate-shaped signal transmission medium (for example, FPC or FFC) F is applied only partially in the longitudinal direction of the actuator 12. Therefore, even if the actuator 12 is enlarged in the multipolar arrangement direction of the electrically-conductive contact members 13 along with increase of the number of signal transmission electrodes, the pressing force of the pre-pressing protruding portions 12*h* with respect to the plate-shaped signal transmission medium F is not largely increased. Therefore, while the operating force to the actuator 12 in a stage before the plate-shaped signal transmission medium F is finally fixed is reduced, the pressing force of the medium pressing portions 12*c* is maintained without being reduced. Therefore, the final fixation state of the plate-shaped signal transmission medium F is obtained well.

Moreover, in the present embodiment, when the actuator (connection operating means) 12 is turned to the "acting position (closed position)", the medium pressing portions 12*c* of the actuator 12 at the position directly opposed to the contact-point portions 13*f* of the electrically-conductive contact members 13 press the plate-shaped signal transmission medium (for example, FPC or FFC) F. Therefore, the contact pressures applied from the medium pressing portions 12*c* of the actuator 12 to the plate-shaped signal transmission medium F are reliably applied to the contact-point portions 13*f* of the electrically-conductive contact members 13 without being dispersed.

Furthermore, in the present embodiment, the groove portions 12*e* are formed in the parts between the medium pressing portions 12*c* of the actuator (connection operating means) 12. Therefore, only the medium pressing portions 12*c* of the actuator 12 are brought into pressure-contact with the upper surface (first surface) of the plate-shaped signal transmission medium (for example, FPC or FFC) F, and the contact pressures of the contact-point portions 13*f* of the electrically-conductive contact members 13 opposed to the medium pressing portions 12*c* of the actuator 12 are more reliably applied to the plate-shaped signal transmission medium F.

Furthermore, in the present embodiment, the elastically deformed portions of the plate-shaped signal transmission medium (for example, FPC or FFC) F generated by pressing by the medium pressing portions 12*c* of the actuator (connection operating means) 12 are housed in the deformation allowing portions 12*f* provided in the actuator 12, and, as a result, the plate-shaped signal transmission medium F is caused to be in a latched state. Therefore, the retainability of the plate-shaped signal transmission medium F is improved.

In addition, in the present embodiment, part of the electrically-conductive contact member 13 including the bearing portion 13*d* is structured to be housed in the bearing housing portion 12*e* provided in the actuator (connection operating means) 12. Therefore, the entire electric connector can be downsized.

Moreover, the bearing housing portion 12*d* provided in the actuator (connection operating means) 12 in the present embodiment is communicated with the deformation allowing portion 12*f*. Therefore, in mold forming of the actuator 12, the structure of a mold for forming the bearing housing portion 12*d* and the turning shaft 12*a* is easily released through the part corresponding to the deformation allowing portion 12*f*, and productivity is improved.

Hereinabove, the invention accomplished by the present inventor has been described in detail based on the embodiment. However, the present invention is not limited to the above described embodiment, and it goes without saying that various modifications can be made within the range not departing from the gist thereof.

For example, in the above described embodiment, the flexible printed circuit (FPC) and the flexible flat cable (FFC) are employed as the plate-shaped signal transmission medium to be fixed to the electric connector. However, the present invention can be similarly applied also to the cases in which other signal transmission media, etc. are used.

Moreover, the actuator according to the above described embodiment is configured to be turned toward the connector front side. However, the present invention can be similarly applied also to an electric connector in which it is configured to be turned toward the connector rear side.

Furthermore, the electric connector according to the above described embodiment employs the configuration in which the electrically-conductive contact members having the same shapes are arranged in multipolar shapes. However, the present invention can be similarly applied also to the configuration using electrically-conductive contact members having different shapes.

The present invention can be widely applied to various electric connectors used in various electric devices.

What is claimed is:

1. An electric connector comprising:

an insulating housing to which a plate-shaped signal transmission medium is to be inserted;

a plurality of contact members arranged in multipolar shapes in the insulating housing; and an actuator attached to the insulating housing turnably about a turning center determined in advance and configured to be subjected to a turning operation from a standby position toward an acting position, the actuator provided with a medium pressing portion configured to be in a disposition relation that the medium pressing portion is pressed against and in contact with a surface of the plate-shaped signal transmission medium in a state in which the actuator is operated to be turned from the standby position to the acting position; wherein the actuator is provided with, in a vicinity part of a downstream side of the medium pressing portion in a direction of the turning operation, a pre-pressing protruding portion(s) that is projecting to a position having a longer distance from the turning center than that of the medium pressing portion and creates a clicking sensation of the turning operation; and the pre-pressing protruding portion is provided in part of a region in a longitudinal direction of the actuator that is a multipolar arrangement direction of the contact members.

2. The electric connector according to claim 1, wherein the pre-pressing protruding portions are disposed in both-side regions in the longitudinal direction of the actuator, and the pre-pressing protruding portion is not provided in a central region in the longitudinal direction of the actuator.

3. The electric connector according to claim 1, wherein the pre-pressing protruding portions are configured to be scattered at an interval determined in advance in the longitudinal direction of the actuator.

4. The electric connector according to claim 1, wherein the contact member is provided with a contact-point portion that is to be brought into pressure-contact with the plate-shaped signal transmission medium; and the pre-pressing protruding portion is provided with a deformation allowing portion formed by space that houses an elastically deformed part of the plate-shaped signal transmission medium in a state in which the contact-point portion of the contact member is in pressure-contact with the plate-shaped signal transmission medium.

* * * * *